US009475015B2

(12) United States Patent
Voss

(10) Patent No.: US 9,475,015 B2
(45) Date of Patent: Oct. 25, 2016

(54) UNIT FOR PRODUCING READY-TO-USE FILLERS BY MIXING A BINDER COMPONENT AND A CURING AGENT COMPONENT

(75) Inventors: Klaus-Wilhelm Voss, Uetersen (DE); Klaus Voss, legal representative, Uetersen (DE)

(73) Assignee: Vosschemie GmbH, Uetersen (DE)

( * ) Notice: Subject to any disclaimer, the term of this patent is extended or adjusted under 35 U.S.C. 154(b) by 1092 days.

(21) Appl. No.: 13/574,692

(22) PCT Filed: Jan. 21, 2011

(86) PCT No.: PCT/EP2011/050834

§ 371 (c)(1),
(2), (4) Date: Jul. 23, 2012

(87) PCT Pub. No.: WO2011/089224

PCT Pub. Date: Jul. 28, 2011

(65) Prior Publication Data

US 2013/0070554 A1 Mar. 21, 2013

(30) Foreign Application Priority Data

| | | |
|---|---|---|
| Jan. 25, 2010 | (DE) | 20 2010 001 363 U |
| Sep. 10, 2010 | (DE) | 20 2010 012 486 U |
| Sep. 10, 2010 | (DE) | 20 2010 012 487 U |
| Dec. 17, 2010 | (DE) | 20 2010 016 702 U |
| Jan. 10, 2011 | (DE) | 20 2011 001 290 U |

(51) Int. Cl.

| | |
|---|---|
| ***B01F 7/00*** | (2006.01) |
| ***B01F 15/02*** | (2006.01) |
| ***B01F 3/08*** | (2006.01) |

(Continued)

(52) U.S. Cl.

CPC ..... *B01F 3/0853* (2013.01); *B01F 7/00808* (2013.01); *B01F 13/003* (2013.01); *B01F 15/00928* (2013.01); *B01F 15/0203* (2013.01); *B01F 15/0205* (2013.01); *B01F 15/0212* (2013.01); *B01F 15/0226* (2013.01); *B01F 15/0237* (2013.01); *B01F 2215/006* (2013.01); *B01F 2215/0039* (2013.01)

(58) Field of Classification Search

CPC . F04B 13/02; B01F 7/00808; B01F 15/0205
USPC ..... 366/160.2, 160.4
See application file for complete search history.

(56) References Cited

U.S. PATENT DOCUMENTS

| | | | | |
|---|---|---|---|---|
| 4,693,397 | A | 9/1987 | Lang | |
| 6,793,387 | B1 * | 9/2004 | Neas | B01F 13/1058 366/160.4 |
| 7,883,262 | B2 | 2/2011 | Voss | |

(Continued)

FOREIGN PATENT DOCUMENTS

| | | |
|---|---|---|
| DE | 33 27 420 A1 | 2/1985 |
| DE | 20 2007 016 136 U1 | 3/2008 |

(Continued)

*Primary Examiner* — Tony G Soohoo
*Assistant Examiner* — Anshu Bhatia
(74) *Attorney, Agent, or Firm* — Kelly & Kelley, LLP

(57) ABSTRACT

The unit for mixing two components filled into containers for producing a ready-to-use filler includes a manual drive for manually driven plungers to force the components out of the containers and to feed the components into a motor-driven mixing device. The manual drive, the containers and the mixing device are arranged on a horizontal base plate.

27 Claims, 35 Drawing Sheets

(51) Int. Cl.
*B01F 13/00* (2006.01)
*B01F 15/00* (2006.01)

(56) References Cited

U.S. PATENT DOCUMENTS

2008/0298167 A1* 12/2008 Voss ..... B01F 7/00808 366/152.6
2009/0014007 A1 1/2009 Brambilla et al.
2009/0140007 A1* 6/2009 Voss ..... B01F 7/00808 222/135
2009/0161480 A1 6/2009 Voss

FOREIGN PATENT DOCUMENTS

DE 20 2008 010 969 U1 12/2008
EP 2027912 A1 2/2009
WO 2006/089769 A1 8/2006

* cited by examiner

Fig. 19
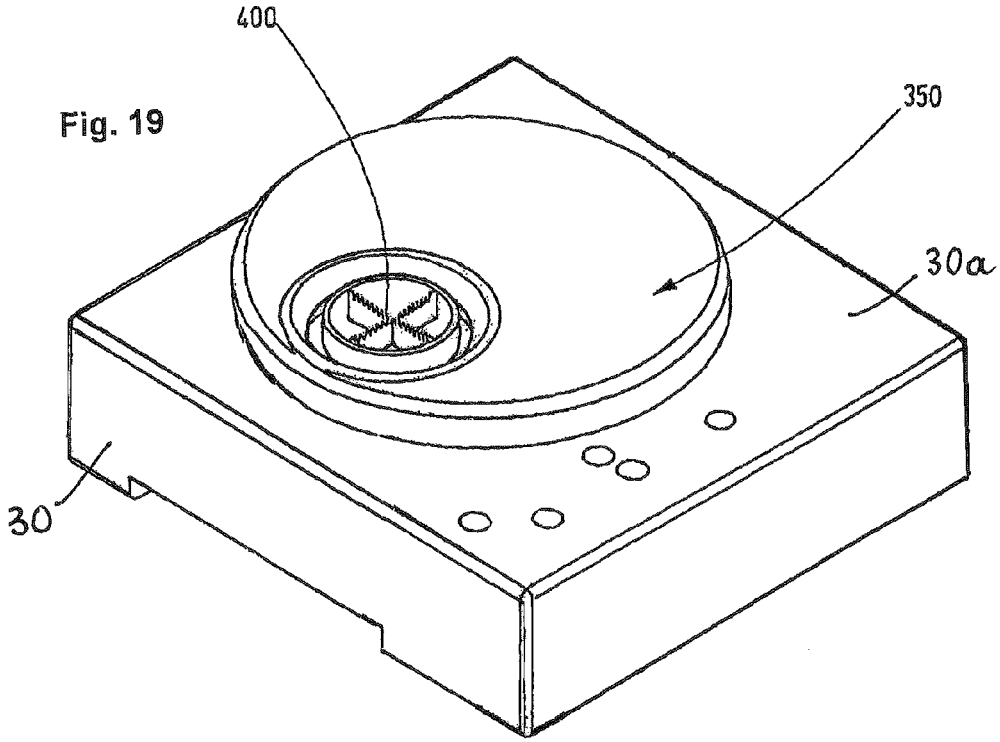
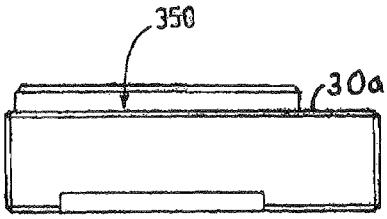
Fig. 21
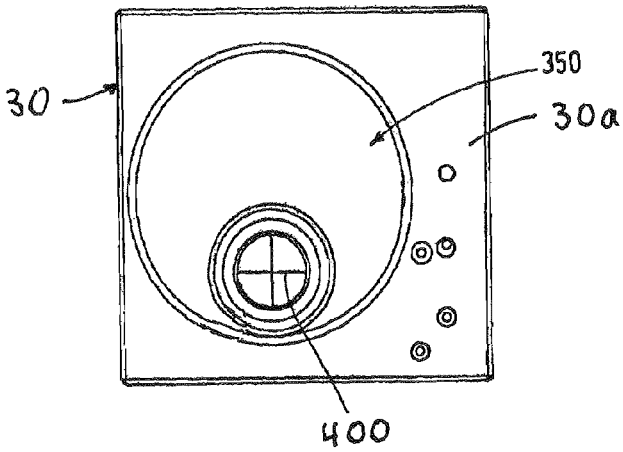
Fig. 20

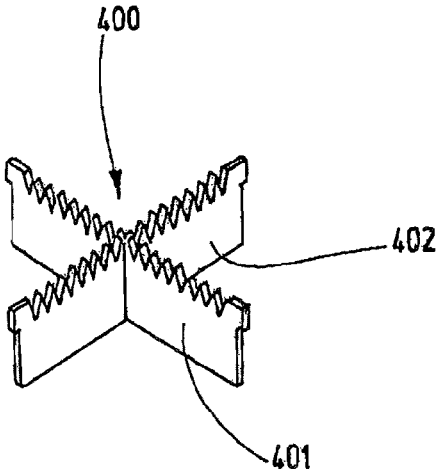
Fig. 30
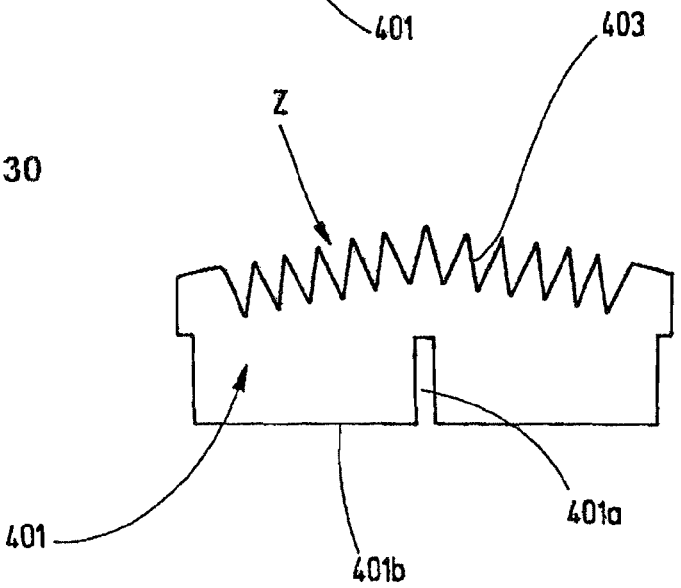
Fig. 31
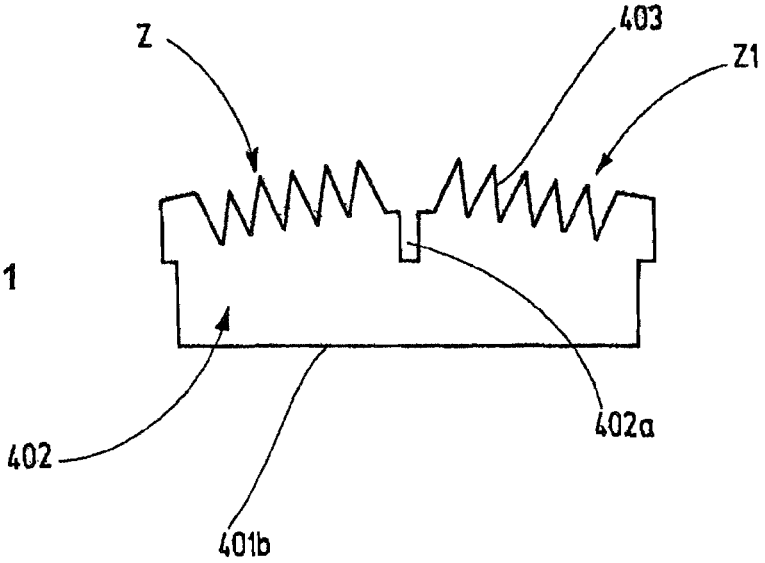

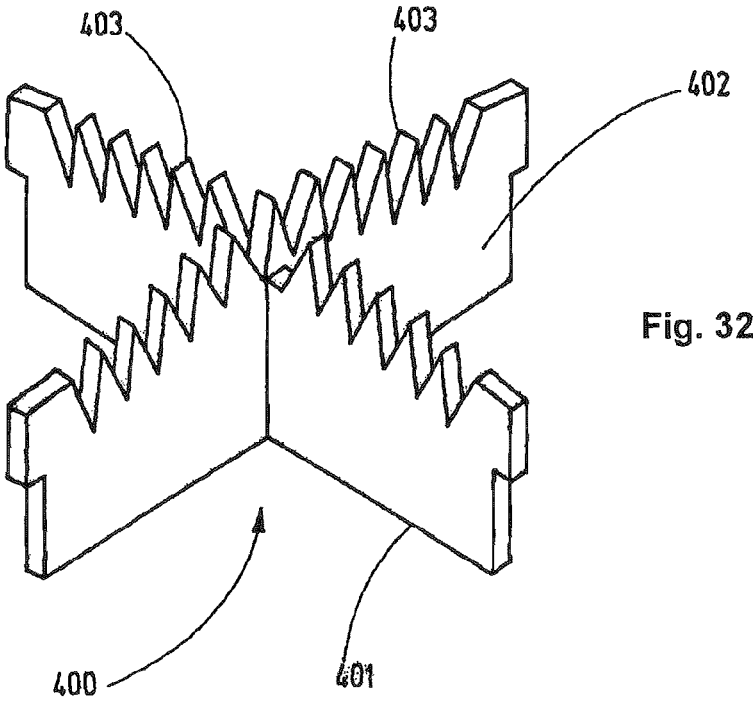
Fig. 32
Fig. 33
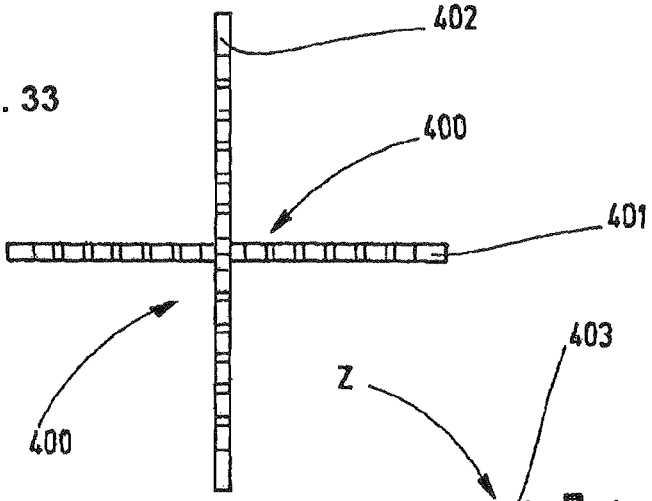
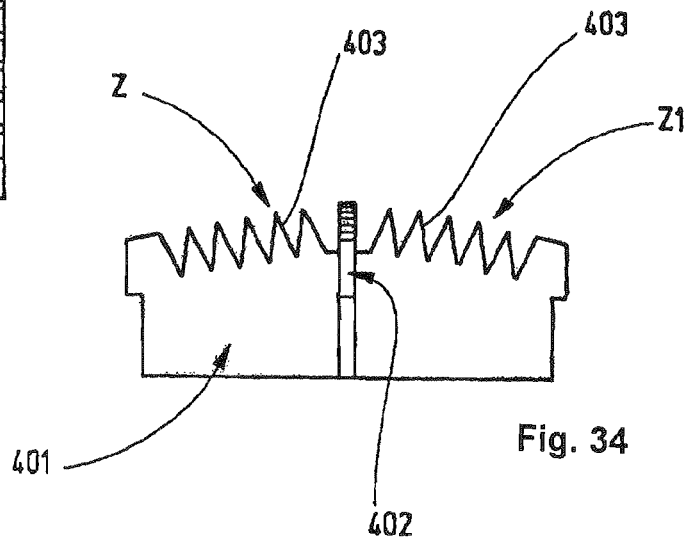
Fig. 34

UNIT FOR PRODUCING READY-TO-USE FILLERS BY MIXING A BINDER COMPONENT AND A CURING AGENT COMPONENT

The present invention relates to a unit for manufacturing ready-to-use fillers by mixing a binder component and curing agent component according to the preamble of claim 1.

For example, units and devices for mixing at least two components are used in manufacturing fillers, wherein a curing agent component containing 1-2% of a binder component is mixed in to generate a curable filler. The mixing device exhibits inlet openings for supplying the respective components, through which the components are added to the mixing chamber of a mixing device. The components are stored in upstream receiving containers, such as can-like containers or cartridges, wherein the mixing device is part of an arrangement for providing fillers.

PRIOR ART

Such a device for manufacturing ready-to-use filler for filling in surfaces, e.g., those of vehicle bodies, is known from DE 203 07 518 U1. The device has two storage containers situated at a base station, of which one is filled with a binder component, specifically a filler component, and the other with a curing agent component. A metering device is used to continuously feed the two components via a respective feed channel to a mixing chamber, in which the components come into contact with each other. The mixing chamber consists of a tubular section of flexible hosing, engaged on the outside by press rolls, which compress the tubular section and at the same time circumferentially drive it around a longitudinal axis. The friction that arises in the process and the adhesion of components to the interior wall of the hose causes the components to become mixed together. After the mixture has passed through the tubular section, it arrives at an outlet opening provided to the hose, where it continuously exits the hose. The hose wall consists of an airtight plastic, so that the air ambient to the hose cannot get into the mixture during the mixing process, and become included therein in the form of pores or cavities.

Known from DE 20 2005 005 833 U1 is a system of units for mixing binder components and a curing agent component into a pasty mixture for manufacturing a ready-to-use filler to fill surfaces, e.g., of vehic bodies, with a carrier plate that is arranged in a unit component and exhibits an inlet opening to supply the binder component from a storage container situated on the carrier plate, and with at least one other inlet opening to supply the curing agent component from a storage container situated on the carrier plate, and with outlet openings connected with the inlet openings via feed channels in the carrier plate, and a mixing device that can be functionally connected with the carrier plate, wherein the mixing device exhibits a number of inlet openings equal to the number of outlet openings and corresponding with the outlet openings, and exhibits a hollow cylindrical stator section with a discharge opening for the mixture formed in its wall and a rotor section concentrically situated in the latter that can rotate around a longitudinal axis, with a mixing chamber resembling an annular gap formed between the stator section and rotor section, wherein several first mixing teeth molded onto the stator section extend radially inward and several second mixing teeth molded onto the rotor section extend radially outward into the mixing chamber, so that a rotational movement of the rotor section in the stator section causes the mixing teeth to move against each other, thereby mixing the two components together, wherein the stator section exhibits at least one inlet opening for the curing agent component connected with the mixing chamber, and wherein the first mixing teeth are situated on at least a first mixing teeth plane and the second mixing teeth are situated on at least a second mixing teeth plane, wherein the mixing teeth planes are axially offset relative to each other in tiers in the direction of the longitudinal axis, so that the second mixing teeth of the rotor section radially revolve in the respective gaps of the first mixing teeth of the stator section, wherein several mixing teeth planes are provided on the rotor section and stator section.

This device mixes the mixing components together in such a way as to reliably cure the mixture. This is achieved first and foremost by virtue of the fact that two storage containers are present, and that these storage containers are connected with the mixing chamber by separate feed channels. A metering device can be used to continuously convey the mixture through the mixing chamber through a discharge opening situated on the stator section.

EP 1 900 443 A2 describes a system of units for manufacturing a ready-to-use filler by mixing a binder and curing agent component. This system of units for mixing at least two components, in particular a binder component A and a curing agent component B, into a pasty or fluid mixture to manufacture a ready-to-use filler to fill surfaces, e.g., of vehicle bodies, encompasses a carrier plate with an inlet opening to supply the binder component A from a storage container situated on the carrier plate, and with at least one other inlet opening to supply the curing agent component B from a storage container situated on the carrier plate, and with outlet openings connected with the inlet openings via feed channels in the carrier plate, and a mixing device that can be functionally connected with the carrier plate, wherein the mixing device exhibits a number of inlet openings equal to the number of outlet openings in the carrier plate and corresponding with the outlet openings, and exhibits a hollow cylindrical stator section with a discharge opening for the mixture formed in its wall and a rotor section concentrically situated in the latter that can rotate around a longitudinal axis, with a mixing chamber resembling an annular gap formed between the stator section and rotor section, wherein several first mixing teeth molded onto the stator section extend radially inward and several second mixing teeth molded onto the rotor section extend radially outward into the mixing chamber, so that a rotational movement of the rotor section in the stator section causes the mixing teeth to move against each other, thereby mixing the two components together, wherein the stator section exhibits at least one, most preferably two, inlet openings for the curing agent component B connected with the mixing chamber, and wherein the first mixing teeth are situated on at least a first mixing teeth plane and the second mixing teeth are situated on at least a second mixing teeth plane, wherein the mixing teeth planes are axially offset relative to each other in tiers in the direction of the longitudinal axis, so that the second mixing teeth of the rotor section radially revolve in the respective gaps of the first mixing teeth of the stator section, wherein several mixing teeth planes are provided on the rotor section and/or stator section, wherein the number of mixing teeth planes on the rotor section and stator section are preferably equal, wherein, to establish the functional connection between the mixing device and carrier plate, the end of the stator section facing away from the inlet openings carries an annular bracket, which exhibits attachment through holes, and is joined with the stator section like a bayonet that can be detached, locked and rotated, wherein the ability to rotate is limited by stops so as to ensure that the inlet opening for binder component A in the mixing device matches the corresponding outlet opening in the carrier plate, and simultaneously that the inlet openings for the curing agent component B in the mixing device matches the corresponding outlet openings in the carrier plate.

This mixing device exhibits a hollow cylindrical stator section and a rotor section incorporated therein so that it can rotate concentrically around a longitudinal axis, and the mixing chamber between the stator section and rotor section is designed like an annular gap, wherein several first mixing teeth molded to the stator section extend radially inward and several second mixing teeth molded onto the rotor section extend radially outward into the mixing chamber, so that a rotational movement of the rotor section in the stator section causes the mixing teeth to move against each other, thereby mixing the two components together, wherein the stator section exhibits at least one, most preferably two, inlet openings for the curing agent component connected with the mixing chamber.

This is because, before the binder component is supplied or the continuous mixing process is initiated prior to the start of each mixing process, the rotational movement of the mixing teeth of the mixer moving against each other causes a quantity of 0.1 grams to 0.5 grams, most preferably 0.2 grams, of pasty or fluid curing agent component to be injected into the mixing chamber, whereupon the supply of binder component and supply of curing agent component takes place.

And this injection of the smallest quantity of curing agent component is triggered and monitored by the controller. Spraying in or injecting a small quantity of pasty or fluid curing agent component before or when each continuous mixing process in the mixing chamber of the device begins is intended to prevent erroneous mixing results, since erroneous mixing results are always encountered in the absence of this advance injection. This stems from the fact that the mixing ratio measures up to 2% to 98% of the binder component and curing agent component. The initial quantity, which measures about 1 $cm^3$, then contains either no curing agent, or a quantity of curing agent so greatly diminished as to potentially result in partially deficient curing. A useable curing result is thus achieved with a percentage of benzoyl peroxide (50% paste) ranging from 0.8% to 5%. Quality problems in the mixture arise at dosage levels above or below this quantitative percentage. Too low a dosage yields an inadequate final hardness. Too high a dosage causes the binder component (filler) to become undesirably enriched with softeners, which comprises about 50% of the curing agent paste. If these standard values are not observed while curing the end product, erroneous end results arise in the lacquering process.

However, this advance step of injecting a small quantity of curing agent component before initiating the actual supply of binder component and curing agent component for the mixing process is not enough for homogeneously mixing at least two components to manufacture ready-to-use, completely curable filler without air pockets. This can be attributed to the fact that the curing agent component has to travel a relatively long way given the relatively large distance between the outlet opening and unit plate or carrier plate of the unit and the inlet opening of the mixing chamber of the mixing device, so that air bubbles included and entrained in the curing agent component compound are also transported into the mixing chamber, and are also not eliminated completely by the rotational movement of the mixing teeth moving against each other while mixing the curing agent component with the binder component.

DE G 93 12 543.7 discloses an industrial cartridge for compounds to be extruded from the latter. This industrial cartridge consists of a sheet metal body, wherein a sheet metal extrusion floor axially shiftable through a pressing element can be introduced into an open end of the body, wherein the other end of the body can be closed by a sheet metal cover that exhibits an outlet opening. The outlet opening can be closed relative to the compound to be extruded by means of a closing element. This closing element is designed as a heat sealing film tightly affixed to the inner surface of the cover, and extending radially outward up to the body, wherein the extrusion floor simultaneously assumes the function of sealing the open end of the industrial cartridge body. The sealing film hermetically seals the outlet opening of the cover from the compound located in the cartridge. In order to prevent the compound from undesirably changing prior to its use, the sealing film serves as a closing element for the cartridge outlet opening. The industrial cartridge is delivered to the end consumer in the state established in this way. The end consumer inserts the cartridge into a manually or pneumatically operated dispensing device, wherein the outlet opening is hooked up to a dispensing line, while a pressing plate of the dispensing device as the pressing element is brought into contact with an outer surface of the extrusion floor. In order to extrude the compounds, the pressing plate is shifted in the direction of the cartridge floor, during which the compound is pressed against the sealing film in the area of the outlet opening, thereby tearing, ripping or destroying the sealing film in the area of the outlet opening, so that the compound is extruded through the outlet opening. The precondition for this is that the sealing film used be designed in such a way as to be destroyed by the pressure exerted by the extruded compound, so as to release the outlet opening for the compound to exit. Such sealing films must exhibit a very slight thickness, and consist of a material that can be destroyed when exposed to a pressure exerted by the pressurized compound. Films made out of tear-resistant plastic are not at all suitable, since they exhibit a relatively high expansibility, and only deform when exposed to pressure, but do not rip. In addition, films such as these which close the outlet openings for the individual components used in manufacturing fillers are only torn open regionally in the edge region of the outlet opening while exposed to the pressure exerted by the pressurized compound during the extrusion process, as a result of which only a small section of the outlet opening is released for the compound to exit, so that the respectively desired and also required quantity is not made available for manufacturing the filler. Aside from that, the film is uncontrollably ripped or torn open in the area of the outlet opening during the extrusion process, which often results in the film breaking down in the edge area of the outlet opening or at another location, so that the compound also exits uncontrollably.

DESCRIPTION OF THE INVENTION

Object, Solution, Advantages

The object of the present invention is to provide a unit according to the kind described at the outset for manufacturing a ready-to-use, completely curable filler without air pockets to fill the surfaces of vehicle bodies by homogeneously mixing a binder component with a curing agent component using two functionally interacting system components, specifically a mixing device and a parent substance supplying device, which is easy to handle, exhibits small dimensions, can be used as a tabletop unit, does not take a lot of space to set up, and can be easily carried by hand when changing locations. The unit is further to be designed in such a way that the curing agent component only has to traverse a very short distance from the time it exits the outlet opening of a unit plate that carries containers for the two components until it gets into the mixing chamber of a mixing device of the unit, most preferably a distance of 1 mm, given a flow channel diameter of 1.5 to 1.6 mm, shortening the distance to save on transit time elapsed until the binder component encounters the curing agent component, so that the first portion of binder component exiting the outlet opening also already contains the required curing agent quantity of about 2%, thereby achieving a uniform time to gel formation of 2 to 3 minutes. When using can-shaped containers for the binder component with an outlet opening on the floor that is closed by a film, an additional object is also to release the outlet opening to allow the binder component to freely and smoothly exit the can-shaped container by tearing or ripping open the sealing film through exposure to pressure exerted by the binder component compound during the first extrusion process.

The object is achieved as described in claim 1.

Advantageous embodiments of the invention are the subject of the subclaims.

According to the above, the invention relates to a unit according to the preamble of claim 1, which is designed in such a way that the unit encompasses:

A roughly rectangular base plate;

A plate-like unit plate arranged perpendicularly in one of the two end regions of the base plate, with inlet openings formed on one of the two plate sides for supplying binder component A and for supplying curing agent component B, and with an outlet opening formed on the other plate side facing away, wherein the inlet openings and the outlet opening are connected via channels inside the unit plate;

A mixing device that consists of a fixed stator section and a motorized rotor section incorporated therein, and is detachably and replaceably arranged on the plate side of the unit plate that faces away and exhibits the outlet opening, wherein an annular gap comprising the mixing chamber is formed between the two cylindrical parts;

One bracket each arranged on the base plate in front of the unit plate for the can-shaped container for binder component A and the cartridge-like container for curing agent component B;

A first, longitudinally shiftable plunger situated parallel to the base plate, with a circular plunger plate to be arranged inside the can-shaped container at one end, and having an outer diameter corresponding to the inner diameter of the can-shaped container;

A second, longitudinally shiftable plunger situated parallel to the base plate, with a circular plunger plate to be arranged inside the cartridge-like container at one end, and having an outer diameter corresponding to the inner diameter of the cartridge-like container, and A hand drive for a controllable, stroke length-dependent forward motion of the wide plunger for controlling the supply of respectively required quantities of components A and B from the can-shaped containers into the mixing device to achieve a usable curing result for the manufactured filler.

The invention encompasses the technical instruction that the unit exhibits a hollow cylindrical stator section with a discharge opening for the mixture integrated into its wall and a rotor section concentrically arranged in the latter that can rotate around a longitudinal axis, with a mixing chamber resembling an annular gap formed between the stator section and rotor section, wherein several first mixing teeth molded onto the stator section extend radially inward and several second mixing teeth molded onto the rotor section extend radially outward into the mixing chamber, so that a rotational movement of the rotor section in the stator section causes the mixing teeth to move against each other, thereby mixing the components A and B, wherein the stator section exhibits an inlet opening for binder component A, and the stator section exhibits an inlet opening for curing agent component B connected with the mixing chamber, and wherein the first mixing teeth are arranged on at least one first mixing teeth plane, and the second mixing teeth are arranged on at least one second mixing teeth plane, wherein the mixing teeth planes are axially offset relative to each other in tiers in the direction of the longitudinal axis, so that the second mixing teeth of the rotor section radially revolve in the respective gaps of the first mixing teeth of the stator section, wherein several mixing teeth planes are provided on the rotor section and/or stator section, wherein the number of mixing teeth planes on the rotor section and stator section are preferably identical.

The drive of the rotor section of the mixing device is designed as an electric motor accommodated in a housing. The mixing device is situated in such a way that the mixing device is held between the unit plate and housing for the mixing device drive, and secured in such a way that the mixing device can be replaced, wherein the distance between the unit plate and drive housing is variable for changing the mixing device.

The mixing device is placed between the unit plate and drive in such a way that the drive shaft of the drive engages the mixing device rotor during operation, wherein the incoming quantities for the binder component A and curing agent component B correspond with the outlet openings in the unit plate for binder component A and curing agent component B.

In order to drive the plungers, the latter are configured as toothed racks in their areas facing the base plate, or provided with set of teeth that operatively interact with the hand drive.

This hand drive for driving and advancing the plungers consists of an actuating lever, the angled end of which is held in a U-shaped, bearing-like housing arranged on the base plate in its end region facing away from the mixing device, and the end of the angled section of which is connected in such a way with a drive shaft running transverse to the longitudinal direction of the plungers and rotatably mounted in the bearing-like housing that swiveling the actuating lever imparts rotation to the drive shaft having two toothed wheels, which, when the actuating lever is swiveled and simultaneously causes the drive shaft to rotate, engage the teeth in the toothed racks of the plungers to advance the plungers by a prescribed amount, wherein the free end of the angled lever segment of the actuating lever facing the drive shaft operatively interacts with a spring, and is provided with a safety catch that is designed as a two-armed angle lever with the two lever arms and pivoted to the actuating lever, wherein the pointed end of its lever arm facing the drive shaft engages into a toothed wheel with asymmetrical tooth flanks arranged on the drive shaft.

The actuating lever is simultaneously used to activate and deactivate the drive for the mixing device, which incorporates the activation/deactivation switch at the free end of the tubular actuating lever, the interior of which accommodates the electrical feeder lines from the drive to the switch.

Based on this structural configuration, binder component A and curing agent component B are manually supplied from the can-shaped container and cartridge-like container to the mixing device via the actuating lever, in that depressing the actuating lever imparts rotation to the drive shaft, wherein the toothed wheels are also made to rotate at the same time, as a result of which they engage into the toothed racks of the plungers, moving the latter in the longitudinal direction of the plungers, wherein the advancing plungers cause the plunger plates lying in the interior spaces of the can-shaped container for binder component A and the cartridge-like container for curing agent component B to force prescribed quantities of binder component and curing agent component out of the containers and into the mixing device. The respective component quantities supplied to the mixing device are prescribed, wherein the length of the respective plunger stroke can be controlled via the safety catch setting.

The invention further encompasses a configuration of the unit designed in such a way a) that binder component A and curing agent component B are supplied to the mixing chamber of the mixing device via controllers in such a way that a slight quantity of curing agent component B is fed to the mixing chamber by expanding the microscopic air bubbles as a preliminary injection relative to the supply of binder component A, wherein the unit exhibits a cartridge-like container filled to half or three-fourths capacity with curing agent component B to ensure an effective expansion of microscopic air bubbles, wherein the outlet opening in the unit plate for the exit of curing agent component B is preferably spaced 1 mm apart from the inlet opening of the mixing chamber for a travel distance of 1 mm for the flow of curing agent component B into the mixing chamber, wherein the feed channel for the curing agent component in the unit plate exhibits a diameter of most preferably 1.5 mm or 1.6 mm in a section lying next to the outlet opening in the unit plate, and wherein a quantity of 1.2 grams to 5 grams, most preferably 0.2 grams, of curing agent component B is sprayed in or injected by expanding the microscopic air bubbles before the continuous mixing process begins, and/or b) that the feed channel for the curing agent component B having a lower viscosity relative to the viscosity of binder component A exhibits a diameter of 1.5 mm to 1.6 mm, wherein the mixing device on the unit plate is arranged in the area of its outlet openings for the two components A and B in such a way that the outlet opening for curing agent component B in the unit plate abuts the inlet opening or inlet borehole for curing agent component B of the mixing chamber and is congruent with the latter, wherein the distance between the outlet opening and inlet opening of the mixing chamber measures the wall thickness of the mixing chamber wall of most preferably 1 mm, so that the travel distance for the flow of curing agent component B from the outlet opening in the unit plate into the mixing chamber corresponds to the wall thickness of the chamber wall.

According to the above, a first technical solution lies in the fact that expanding microscopic air particles or microscopic air bubbles in the compound of curing agent component B are used based on the structural configuration of the unit, wherein the expansion only functions effectively if the cartridge-like container for curing agent component B is filled to roughly half or one-fourth capacity, because the less filled the cartridge-like container is, the lower the pressure of microscopic air pockets in the compound of curing agent component B. However, at a very low fill level, the pressure is inadequate to achieve a usable preliminary injection. This is why filling the cartridge-like container requires that there be enough pressure to allow the compound to be compressed, so that when the pressure on the microscopic air pockets is relieved, the latter cannot expand, and hence neither can the compound, thereby allowing the required quantity of curing agent component B to flow into the mixing chamber of the mixing device for a preliminary injection.

Therefore, the invention provides that the exit of curing agent component B be shifted to a point where the curing agent component only has to travel a bit longer, i.e., quasi by only the 1 mm material thickness of the mixing chamber of the mixing device, in order to become effective as a preliminary injection, especially since binder component A is clearly thicker in terms of viscosity by comparison to the viscosity of curing agent component B. As a result, the mixing device has to remain on the unit until such time as a new mixing process takes place.

It was surprisingly discovered that monitoring the outlet opening for curing agent component B on the cartridge-like container or on the unit plate up to the inlet opening for curing agent component B of the mixing device until into the mixing chamber of the mixing device prevents irregularities in mixing the two components A and B and manufacturing the filler after the mixing process is completed, as well as in the filler subsequently cured after being processed.

The microscopic air bubbles, i.e., air bubbles, present in curing agent component B, which is most preferably a benzoyl peroxide paste or cyclohexanone peroxide paste, are here used to achieve a very small quantity of curing agent component B for preliminary injection when mixing binder component A, which is a polyester compound, with the benzoyl peroxide paste of curing agent component B. While manufacturing the benzoyl peroxide paste out of benzoyl chloride in a water bath, it is cooled with ice for cooling purposes. The more the water temperature rises during the reaction, the more the ice melts. The benzoyl peroxide has a crystalline structure. This is followed by a reaction with a softener. Slight quantities of air are included in the process. A paste comprised of benzoyl peroxide and softener contains a very slight quantity of microscopic air bubbles, which bring about a weak compressibility of the material. However, this effect varies in intensity depending on the fill level of curing agent component in the cartridge-like container, as a result of which the plurality of microscopic air bubbles in the curing agent component yields a high compressibility when the cartridge-like container is completely filled with the curing agent component B, and this compressibility enables an advance feed of curing agent component B to the mixing device, especially since given a cartridge-like container completely filled with curing agent component, it is enough for a follow-up pressure to come about that is sufficient to already force a slight quantity of about 0.1% of curing agent component B into the mixing chamber of the mixing device, so that a quantity of curing agent component B gets into the mixing chamber for preliminary injection at the start of the tapping process already. The quantity of curing agent component sprayed or injected into the mixing chamber of the mixing device via the expanding microscopic air bubbles measures 0.1 grams to 5.0 grams, most preferably 0.2 grams.

This advance feed in the form of spraying a slight quantity of curing agent component before the actual supply of binder component and curing agent component for the mixing process does not constitute an advance feed for achieving a proportional provision of binder component and curing agent component, because the curing agent component cannot measure more than 4%, since impermissible reactions would otherwise set in, possibly allowing a peroxide bleaching effect of the color pigments contained in the curing agent component to arise as well.

In a second technical solution that can also be combined with the first technical solution, the flow channel for curing agent component B in the unit plate exhibits a diameter of 1.5 to 1.6 mm, so that the path to be covered by the curing agent compound is just as large as the wall thickness of the mixing device, specifically 1 mm. Due to the low viscosity of curing agent component B, the process of mixing with the supplied binder component in the mixing zone sets in right away, thus yielding a slight preliminary injection, or eliminating the need for a preliminary injection. As a result, the preliminary injection might be entirely or only partially necessary. Shortening the path from the outlet opening in the unit block until into the mixing chamber of the mixing device saves on the transit time in which binder component A impinges upon curing agent component B, so as to then become mixed together by the rotational movement of the rotor of the mixing device and mixing teeth. When added to the rotational movement of the mixing device rotor, the combination of the curing agent component with the low viscosity, and the resultant low viscosity, cause the two components A and B to become mixed together from the very outset, i.e., already when the two components A and B converge, so that the first portion of binder component A that exits the outlet opening of the unit plate also already contains the required quantity of curing agent component B of about 2%, thereby yielding a uniform time to gel formation, specifically 2 to 3 minutes.

It is especially advantageous to arrange a check valve in the feed channel in the unit plate to supply the curing agent component B to the mixing device, since this prevents a reflux of curing agent component B after having relieved the pressure applied to the curing agent compound in the feed channel for curing agent component B in the unit plate of the unit. This technical configuration prevents any and all reflux, so that no malfunctions can arise.

In addition, the invention encompasses a can-shaped container for binder component A, with a film that is situated on the interior wall surface of the floor plate and closes the outlet opening of the can-shaped container, wherein the area of the outlet opening of the can-shaped container incorporates a knifelike or serrated cutting device that functionally acts on the film or a film section during the process of extruding the binder component A out of the can-shaped container, and consists of two crossed molded bodies designed like saw blades, with saw teeth facing the film section in the area of the outlet opening for cutting into and opening the film or the film section to release the outlet opening of the can-shaped container so binder component A can exit, wherein the cutting device is situated in the area of the outlet opening of the can-shaped container or in the area of the inlet opening for binder component A of the mixing device.

In another embodiment, the cutting device for cutting into and opening the film or a film section is situated in the area of the outlet opening of the can-shaped container in the outer wall region of the floor plate of the can-shaped container in such a way that, during or after placement of the can-shaped container on the unit plate in the area of its inlet opening for binder component A, the teeth of the cutting device, when exposed to pressure exerted by the compound of binder component A during the first extrusion process, tear into the film section that closes the outlet opening by making preferably central indentations to form bent, flap-like film sections, releasing an opening to allow passage by the compound of binder component A.

As a consequence, the can-shaped container is designed in such a way that the can-shaped container for binder component A, the floor of which is closed by means of a floor plate exhibiting an outlet opening, is provided with a film that is situated on the interior wall surface of the floor plate and closes the outlet opening of the can-shaped container, wherein the area of the outlet opening of the can-shaped container incorporates a knifelike or serrated cutting device that functionally acts on the film or a film section in the area of the outlet opening during the process of extruding the binder component A out of the can-shaped container, cutting into and opening the film or a film section to release the outlet opening of the can-shaped container so binder component A can exit, wherein the cutting device is situated in the area of the outlet opening of the can-shaped container or in the area of the inlet opening for binder component A of the mixing device, wherein the cutting device consisting of two crossing molded bodies designed like saw blades, with saw teeth facing the film section in the area of the outlet opening, is arranged in the area of the outlet opening of the can-shaped container or in the area of the inlet opening for binder component A of the mixing device, wherein the cutting device is arranged relative to the film in such a way that the film is pressed against the cutting device through exposure to pressure during the extrusion process for binder component A, and opened by the latter.

The cutting device is an integrated component of the can-shaped container on the one hand, while on the other hand the cutting device is an integrated component of the unit plate connected with the mixing device, which is removed following use of the unit, and can be replaced with a new, unused mixing device.

As a consequence, the can-shaped container exhibits a floor plate with an outlet opening closed for transport by a smooth or corrugated plastic film, and a cutting device that functionally interacts with the container to open the film for use, which can be an integrated component of the can-shaped container or integrated component of the unit plate of the unit.

Arranging the knifelike cutting device, which in particular takes the form of especially crossing molded bodies designed like saw blades, in the area of the outlet opening of the can-shaped container makes it possible to open the film section closing the outlet opening by having the cut film release the outlet opening to allow binder component A to exit, as the pressed compound laterally pushes away the individual film sections generated by the cuts made into the film. Because the sharp-edged blades or serrated blades of the knifelike cutting device abut against the outer wall surface of the film section lying in the area of the outlet opening, the film section is exposed to the pressurized compound, simultaneously causing a cut to be made into the film section, thereby opening the film section.

As a consequence, the objective of the cutting device is to prepare the process of opening the film in the area of the container outlet opening in such a way that the compound being forced out of the container tears open the film completely, allowing the compound to exit freely.

Another advantage is that all types of films can be cut open. The film is here prevented from expanding, which would impede or prevent the process of cutting in.

The cross-shaped cut introduced into the film via the cutting device yields four circular film sections (sectors), the arced sections of which can stick to the continuous edge of the outlet opening on the floor plate of the can-shaped container, but be flipped laterally back by the compound being forced out of the container in such a way as to almost completely release the outlet opening so that the compound can exit.

The cutting and molding device for cutting into and opening the film or film section is situated in the area of the outlet opening of the can-shaped container in the outer wall region of the floor plate of the can-shaped container in such a way that, during or after placement of the can-shaped container on the unit plate, with the mixing device in the area of its inlet opening for binder component A, the teeth of the cutting device, when exposed to pressure exerted by the compound of binder component A during the first extrusion process, tear into the film section that closes the outlet opening by making preferably central indentations to form bent, flap-like film sections, releasing an opening to allow passage by the compound of binder component A.

With the can-shaped container placed on the unit plate or set against the unit plate, the cutting device is situated in the area of the inlet opening of the unit plate corresponding with the outlet opening of the can-shaped container in such a way that the cutting device provided on the unit plate abuts against the film in the area of the outlet opening of the can-shaped container, wherein the binder component A pressed against the outlet opening of the can-shaped container is able to press the film section lying in the area of the outlet opening against the cutting device, thereby destroying or tearing it open by introducing cuts to release the flow of binder component A out of the outlet opening of the can-shaped container. The unit plate is shaped in such a way as to function as a support and centering device.

In order to increase the stability of the can-shaped container on or against the unit plate of the mixing device, it is provided that a conically tapering adapter is molded onto the outer wall surface of the floor plate of the can-shaped container in the area of the outlet opening, and can be introduced into the inlet opening of the borehole of the support and centering plate with the can-shaped container placed on the support and centering plate. The cutting device can then be arranged in the inlet opening of the unit plate.

According to the invention, the cutting device consists of at least one knifelike molded body with the blade or set of teeth facing the outlet opening of the can-shaped container.

The cutting device most preferably consists of two crossed, interconnected knifelike or serrated molded bodies, wherein each molded body exhibits a sharpened set of teeth allocated to the outlet opening of the can-shaped container.

This special configuration of the cutting device causes cross-shaped cuts to be introduced into the film in the area of the outlet opening of the can-shaped container. If the cutting device exhibits a cross-shaped arrangement of two serrated molded bodies provided with sharpened sets of teeth, the film is perforated with cross-shaped cuts, as a result of which the pressure exerted on the film by the extruded compound introduces cross-shaped cuts or rips into the film, wherein the latter is primarily conveyed through the perforated, cross-shaped incisions. The film, i.e., the film section lying in the area of the outlet opening of the can-shaped container, is here cut or ripped open in such a way as to yield four individual, roughly triangular film sections, which are pushed laterally away by the compound being forced out of the can-shaped container, thereby releasing the outlet opening for the compound to flow out.

In another embodiment of the cutting device, all teeth of each serrated molded body exhibit the same height.

In addition, each serrated molded body of the cutting device exhibits a row of teeth, in which each second tooth has a greater height relative to the other teeth. This configuration introduces preliminary rips into the film, after which the film is torn even further.

These preliminary rips into the film are achieved by configuring the cutting device in such a way that each molded body exhibits a row of teeth in which the respective outer teeth are higher by comparison to the other teeth. It is also possible to provide the teeth in the central region of the cutting device with the crossed saw blades with a greater height in relation to the height of the other teeth, especially since this configuration also causes the film to be preliminarily ripped or torn open.

In an embodiment of the cutting device where the row of teeth in each molded body exhibits an arced progression, the advantage is that the cutting process starts by first cutting or tearing into the central region of the film, after which the edge areas of the film are cut or ripped into as pressure continues to act on the film.

The same effect is also achieved in an embodiment where each molded body exhibits a row of teeth comprised of two sections of rowed teeth extending conically outward toward the middle of the molded body, wherein the end regions of the two rows of teeth pass over into sharpened, knifelike sections.

In another embodiment, each molded body consists of two rows of teeth that each exhibit at least two teeth, and extend conically outward toward the middle of the molded body, wherein the outer end region of the two rows of teeth pass over into sections resembling tapered taps.

The teeth of each row of teeth in the molded body of the cutting device are sharpened until razor-sharp, so as to achieve a high cutting force on the film.

The unit designed according to the invention provides a mixing unit that exhibits a compact construction, is easy to handle, and effortlessly transportable, making it possible at any time to switch locations from one workplace to another workplace. The unit permits a precise metering of the two components supplied to the mixing device, wherein the components can be metered via the number of actuating lever strokes using the specially configured hand drive.

In addition, the design of the unit makes it possible to mix together at least two components, in particular a binder component A with a curing agent component B, to form a pasty mixture for manufacturing a ready-to-use, completely curable filler to fill surfaces of vehicle bodies, in particular by shortening the path between the curing agent component B to the binder component A, so as to achieve a uniform time to gel formation for the two components of 2 to 3 minutes.

Additional measures for improving the invention are indicated in the subclaims, or are expounded upon in greater detail below in the description of the invention based on the figures, which also constitute the subject matter of the invention.

BRIEF DESCRIPTION OF THE DRAWINGS

Shown on:

FIG. 19 is a diagrammatic view of the unit plate with integrated cutting device in the inlet opening for the binder component, FIG. 20 is a top view of the unit plate, FIG. 21 is a top view of the unit plate, FIG. 30 is a diagrammatic view of the cutting device with crossed, serrated molded bodies having rows of saw teeth with sharpened teeth, FIG. 31 are side views of the two serrated molded bodies making up the cutting device, FIG. 32 is a magnified diagrammatic view of the two crossed, assembled, serrated molded bodies with rows of saw teeth that pass over into end sections tracing a straight line, FIG. 33 is a top view of the two crossed, serrated molded bodies, FIG. 34 is a side view of one of the two serrated molded bodies with arced saw teeth.

PREFERRED EMBODIMENT OF THE INVENTION

Figure 13:
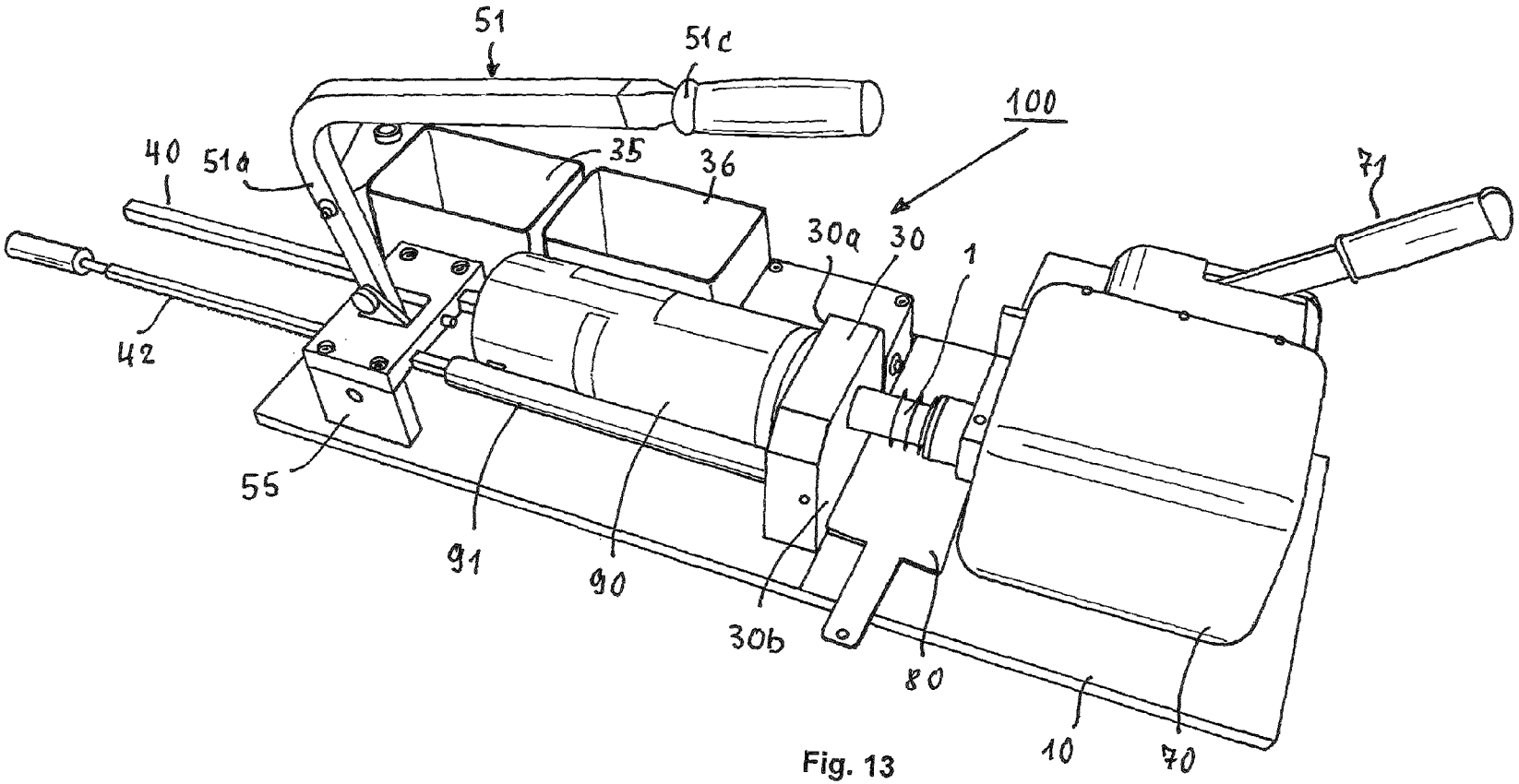
FIG. 13 is a diagrammatic top view of the unit.
Figure 14:
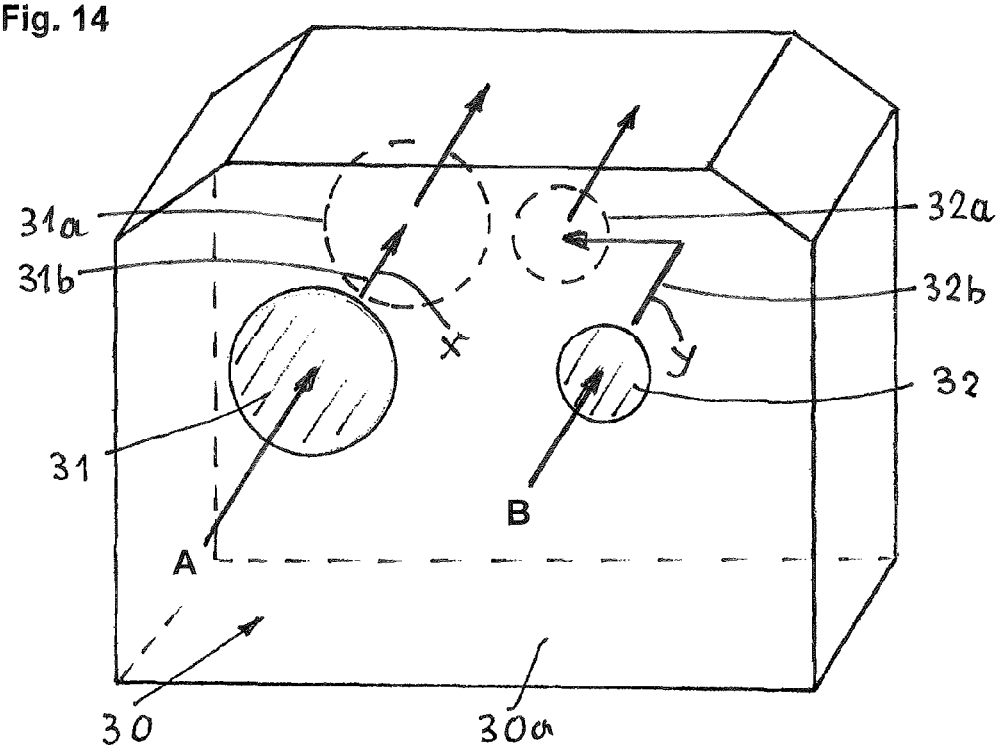
FIG. 14 is a diagrammatic front view of the unit plate.
Figure 15:
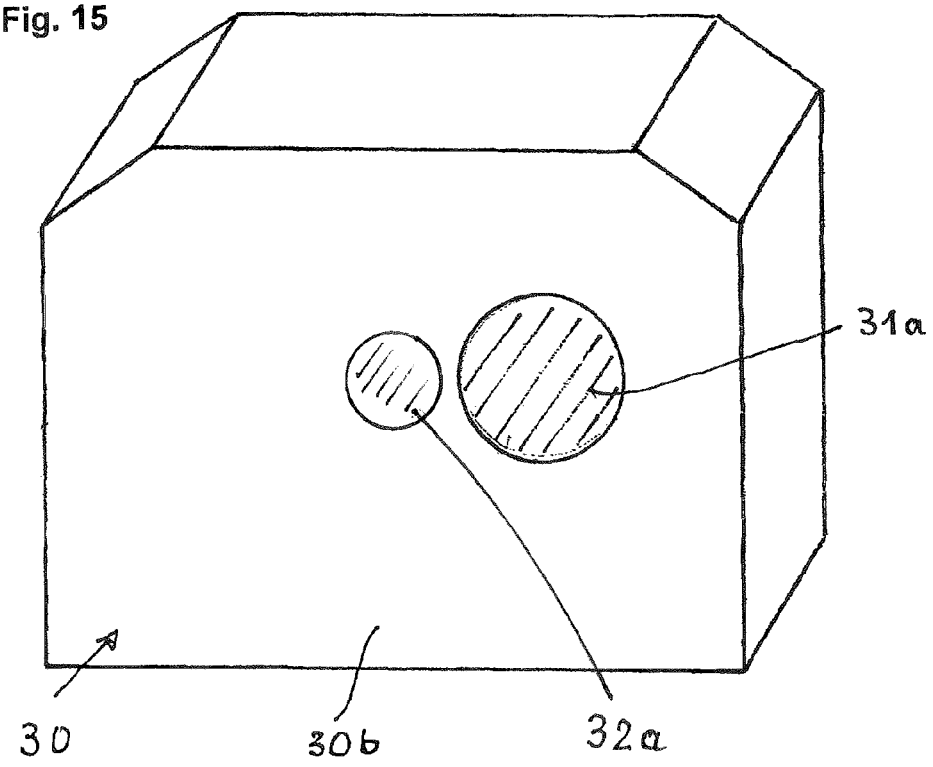
FIG. 15 is a diagrammatic rear view of the unit plate.

The unit 100 designed according to the invention for mixing at least two components, in particular a binder component A and a curing agent component B, to form a pasty [mixture]. According to FIGS. 1 to 4 and 7 to 13, the mixing device for manufacturing a ready-to-use filler consists of an approximately rectangular base plate 10, whose end accommodates a perpendicularly situated, plate-shaped unit plate 30, the one plate side 15*a* of which exhibits two inlet openings 31, 32 for supplying binder component A from a can-shaped container 90 and curing agent component B from a cartridge-like container 91, and the other plate side 30*b* of which exhibits two outlet openings 31*a*, 32*a*, to which is connected a mixing device 1 (FIGS. 14, and 15).

The inlet openings 31, 32 are connected with the outlet openings 31*a*, 32*a* via channels inside the unit plate 30.

The mixing device 1 is situated on the plate side 30*b* facing away from the outlet openings 31*a*, 32*a* of the unit plate 30 in such a way that it can be detached and replaced (FIGS. 2, 3, 4, 10 and 11).

Figure 1:
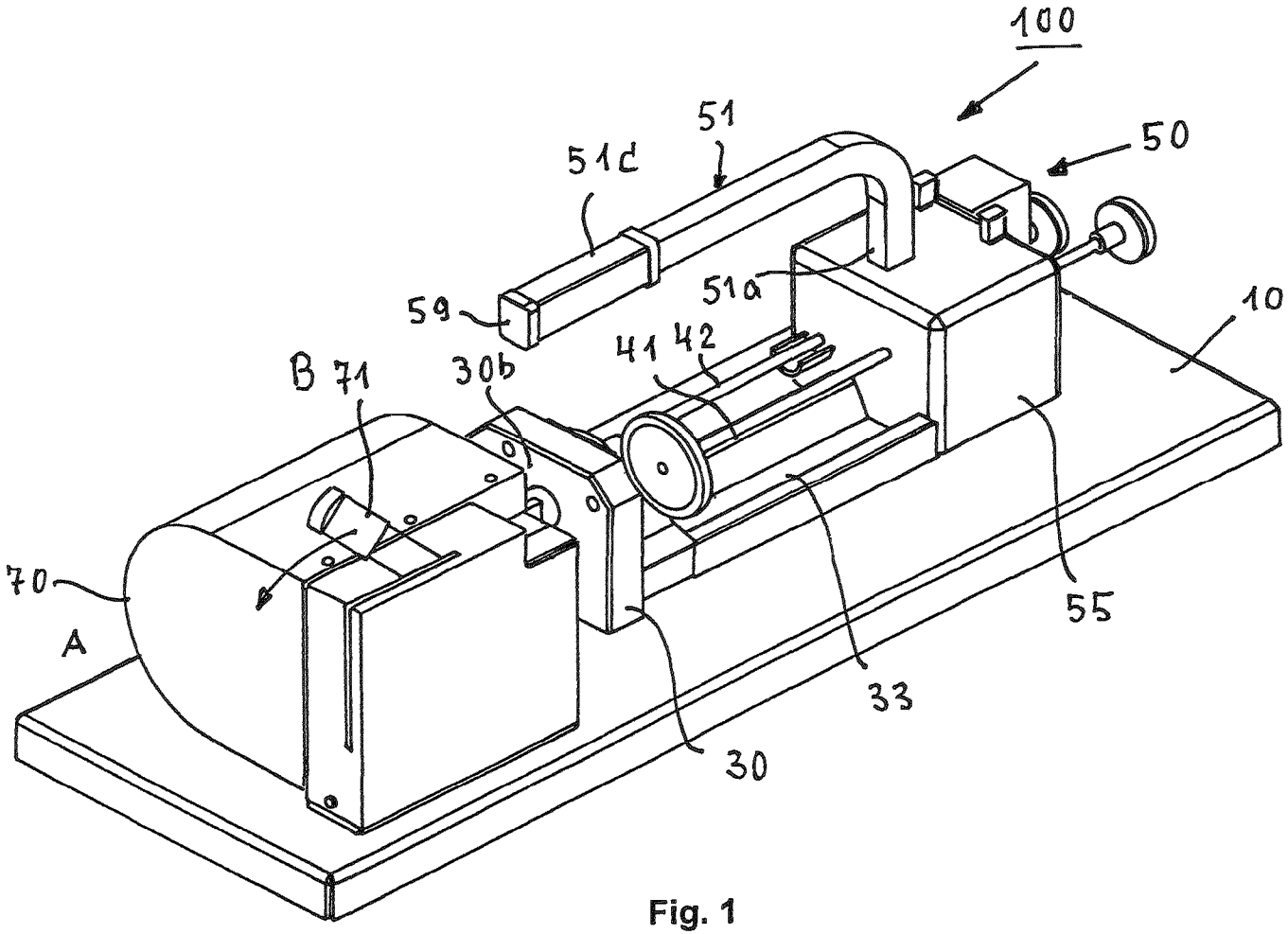
FIG. 1 is the unit according to the invention for mixing a binder component with a curing agent component, with extended plungers carrying plunger plates, without containers for the two components placed in the unit, in a diagrammatic view from the side of the drive for the mixing device.
Figure 2:
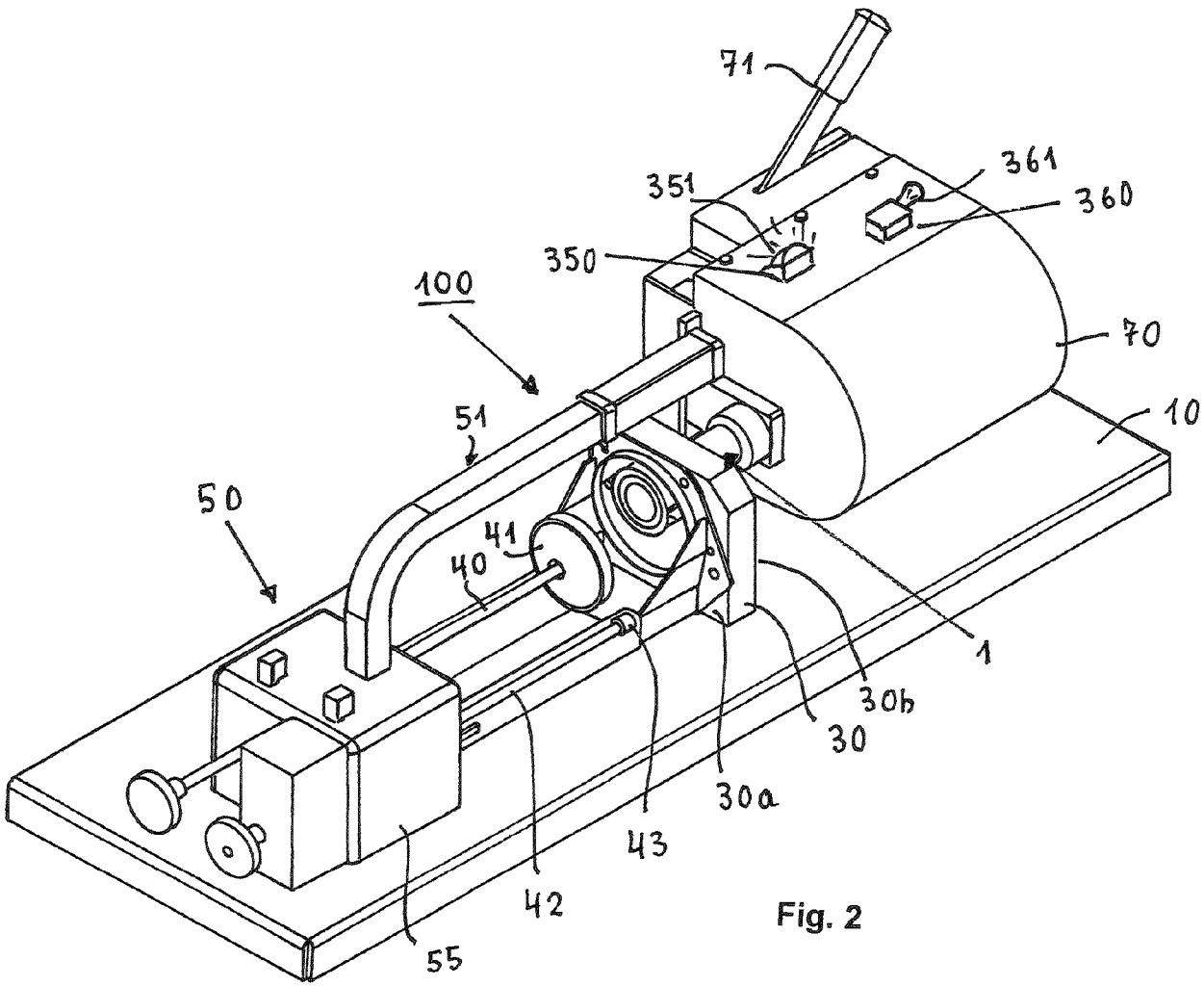
FIG. 2 is the unit according to FIG. 1 in a diagrammatic view from the side of the hand drive, with the actuating lever and the drive for the plungers functionally interacting with the latter.

In addition, the base plate 10 in front of the unit plate 30 is provided with a tub-shaped bracket 33 for the can-shaped container 90 with binder component 1 and for the cartridge-like container 91 with curing component B, wherein differently designed brackets can also be used (FIGS. 1 and 2).

Both the can-shaped container 90 and the cartridge-like container 91 most preferably exhibit a cylindrical container body with a circular cross section.

In order to be able to force binder component A out of the can-shaped container 90 and curing agent component B out of the cartridge-like container 91, so as to feed the two components A and B to the mixing device 1, a longitudinally shiftable plunger 40 with a circular plunger plate 41 located at one end and having an outer diameter corresponding to the inner diameter of the can-shaped container 90 is situated parallel to the base plate 10 (FIGS. 1, 2, 3, 10, 11, 12 and 13).

In order to extrude curing agent component B from the cartridge-like container 91, a second, longitudinally shiftable plunger 42 situated parallel to the base plate 10 is provided at one end with a circular plunger plate 43, the outer diameter of which corresponds to the inner diameter of the cartridge-like container 91. If the two containers 90, 91 exhibit no cylindrical container body with a circular inner diameter, but rather an inner diameter having another geometric shape, the plunger plate 41 exhibits the geometric shape of the container.

The plungers 40, 42 are actuated by way of a hand drive 50, which is used to control the respective and required stroke length of the plungers 40, 42 to feed the respectively required quantities of components A and B from containers 90, 91 into the mixing device 1, so as to achieve a usable curing result for the manufactured filler (FIGS. 1, 2, 3, 4 and 8). To drive the two plungers 40, 42, the latter are designed as toothed racks in their regions facing the base plate 10. The plungers 40, 42 can themselves also be provided with a perforation. These toothed racks or perforations operatively connect the plungers 40, 42 with the hand drive 50 (FIGS. 4, 5, 6 and 9).

The hand drive 50 consists of an actuating lever 51 that can be manually activated and pivoted, a drive shaft 52, two toothed wheels 53, 54 arranged on the drive shaft 52, and a safety catch 60 (FIGS. 3, 4, 5, 6, 7, 8 and 9).

Figure 3:
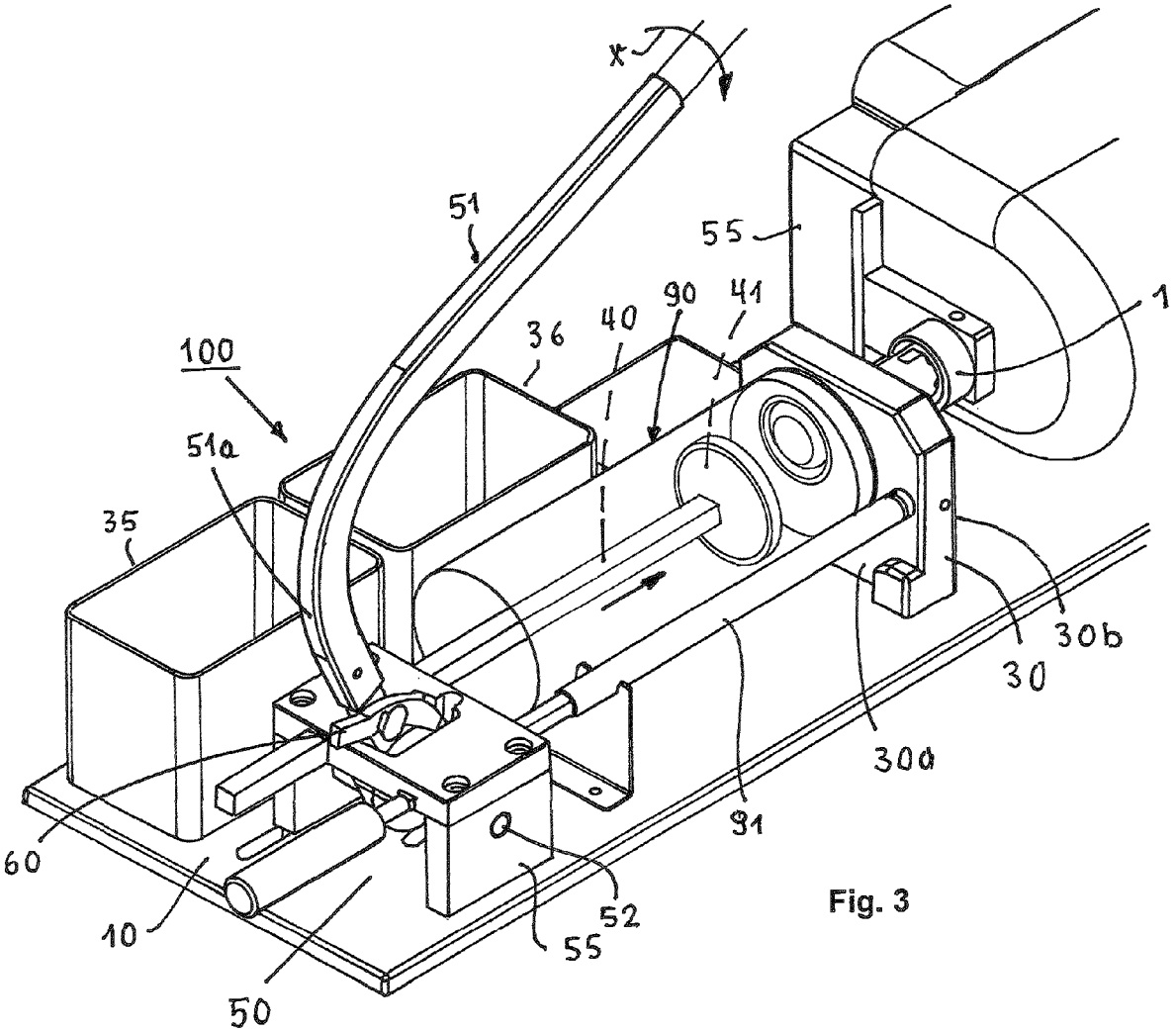
FIG. 3 is a diagrammatic view of the device with containers placed between the mixing device and plunger drive for the two components, with plungers extended, and plunger plates lying inside the two containers, as well as with vessels arranged on the base plate of the unit for used and unused mixing devices.
Figure 4:
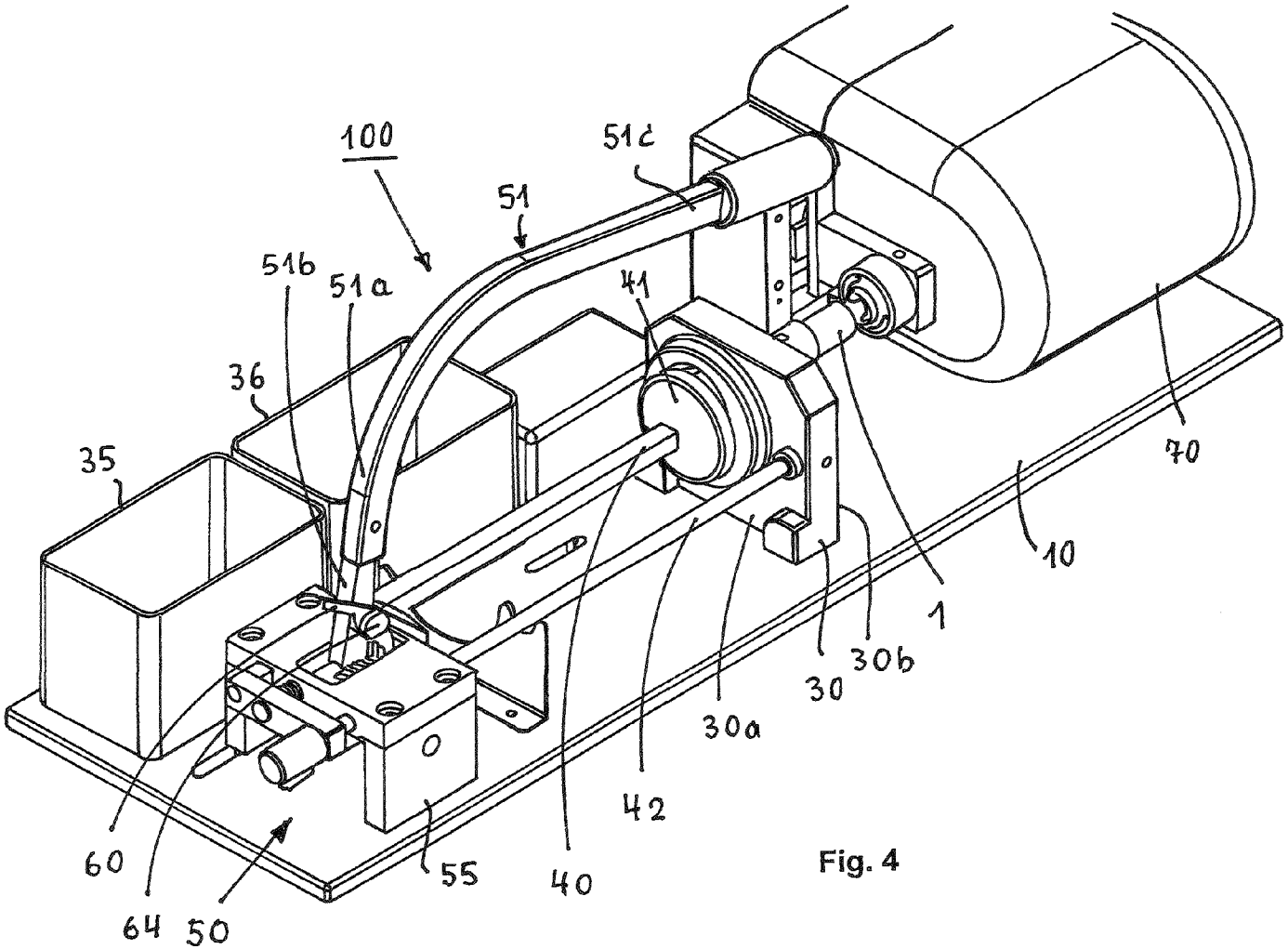
FIG. 4 is a diagrammatic view of the unit with plungers extended to the end position, and the actuator lever for the plungers swiveled into the end position, as well as with the drive arrangement for the mixing device, FIG. 5, 6 are magnified diagrammatic partial views of the drive for the plungers of the unit according to FIG. 4.

According to FIGS. 3 and 4, the hand drive 50 for driving and advancing the two plungers 40, 42, as well as for retrieving the latter, encompasses an actuating lever 51 with a slightly curved, shorter lever segment 51*a*, the end 51*b* of which is held in a U-shaped, bearing-like housing 55, which is arranged on the base plate 10 of the unit 100, specifically in the end region of the base plate 10 facing away from the mixing device 1 (FIGS. 3 and 4).

The end 51*b* of the angled segment 51 of the actuating lever 51 is connected in such a way with a drive shaft 52 running transverse to the longitudinal direction of the plungers (40, 42) and rotatably mounted in the bearing-like hosing 55 that swiveling the actuating lever 51 imparts a rotation to the drive shaft 52 (FIGS. 5, 6, 7 and 8). This drive shaft 52 carries two toothed wheels 56, 57, which engage into the teeth of the toothed racks or perforation of the two plungers 40, 42. When the actuating lever 51 is manually swiveled in the direction of the arrow X on FIG. 3 into the position depicted on FIGS. 4 and 7, the drive shaft 52 is made to rotate, as a result of which the two plungers 40, 42 are moved in the direction toward the mixing device 1, wherein a quantity of components A and B is simultaneously forced out of the containers 90, 91, and fed to the mixing device 1. The respective quantities of components A and B supplied to the mixing device 1 depend on the respective length of the stroke with which the plungers 40, 42 are moved in the direction toward the mixing device 1.

Figure 5:
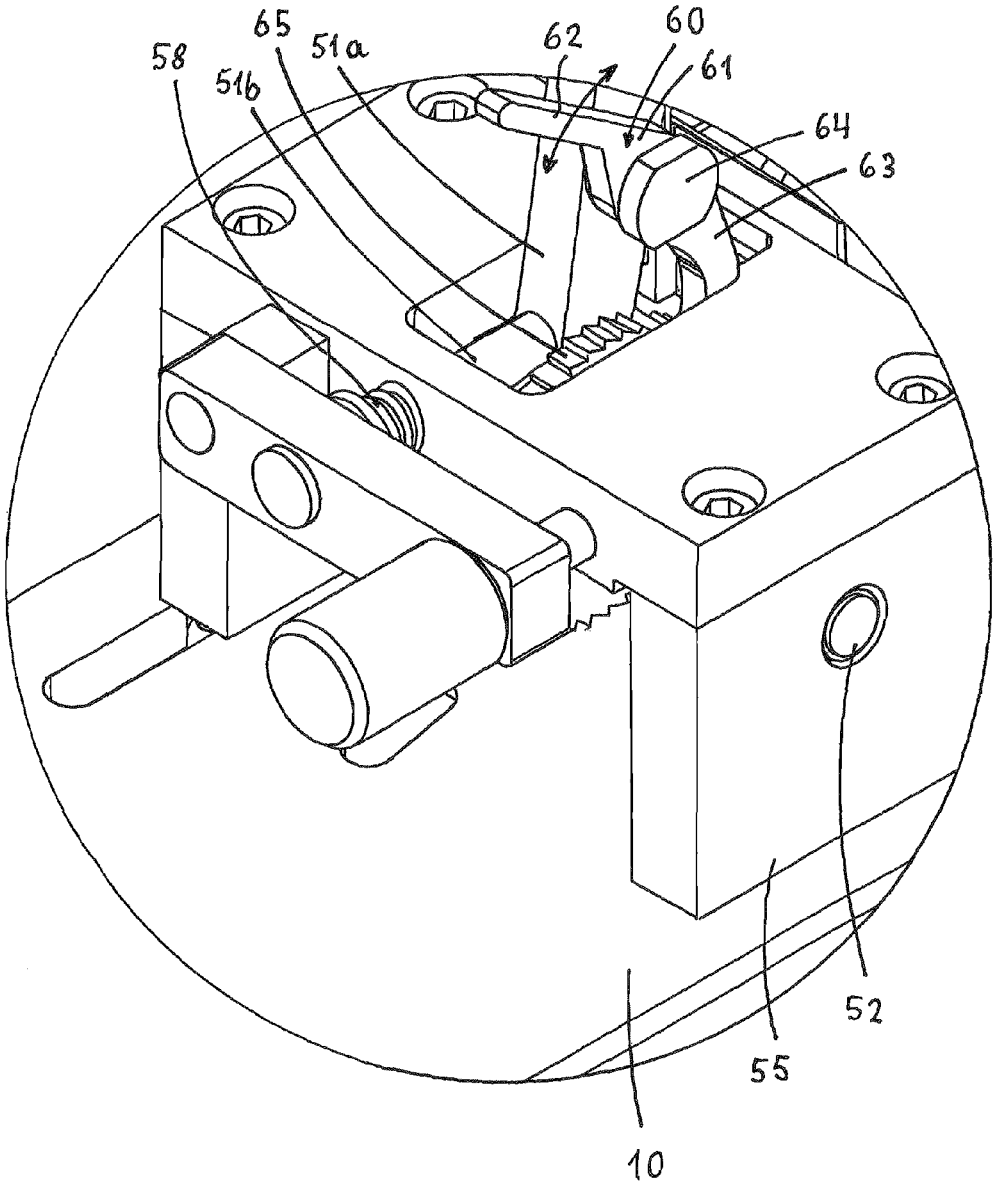
Figure 6:
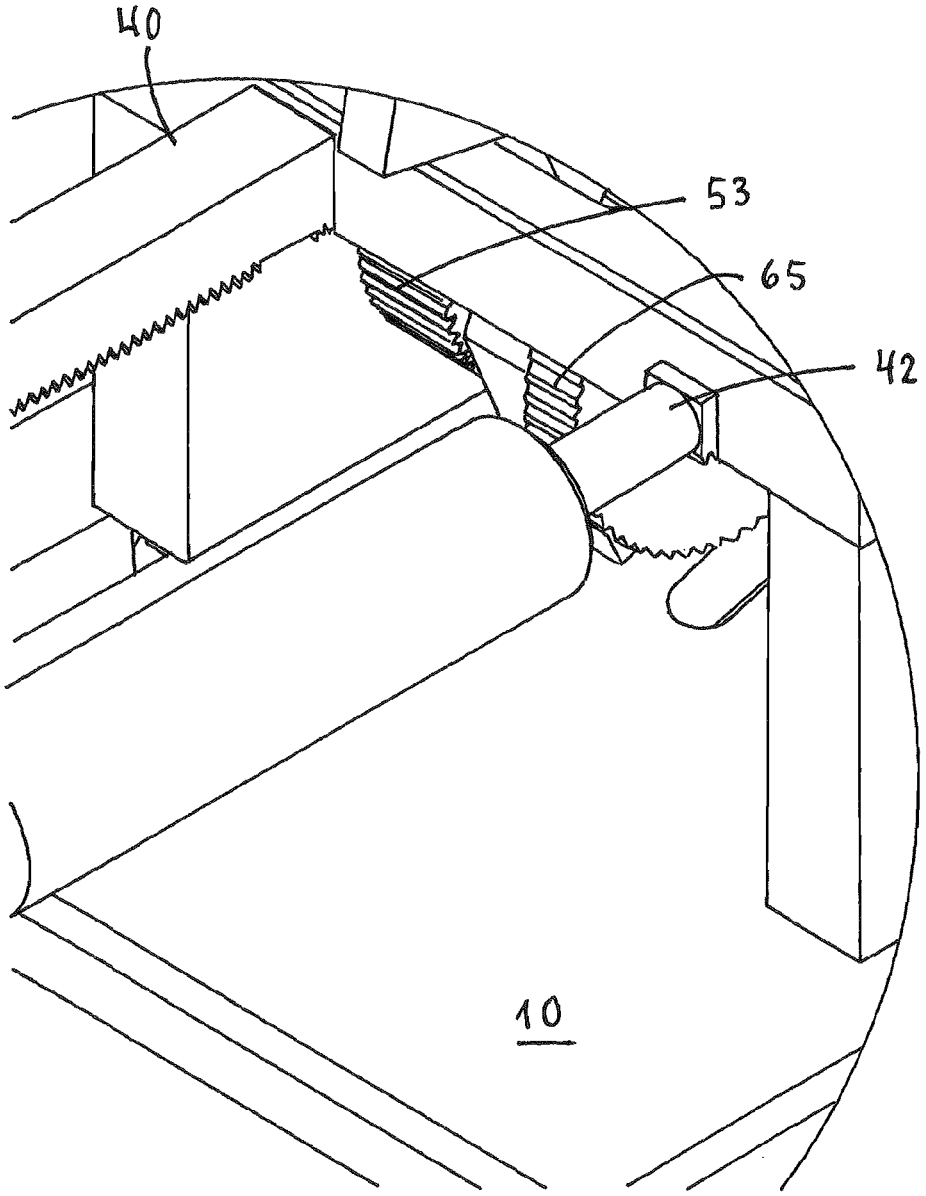
Figure 7:
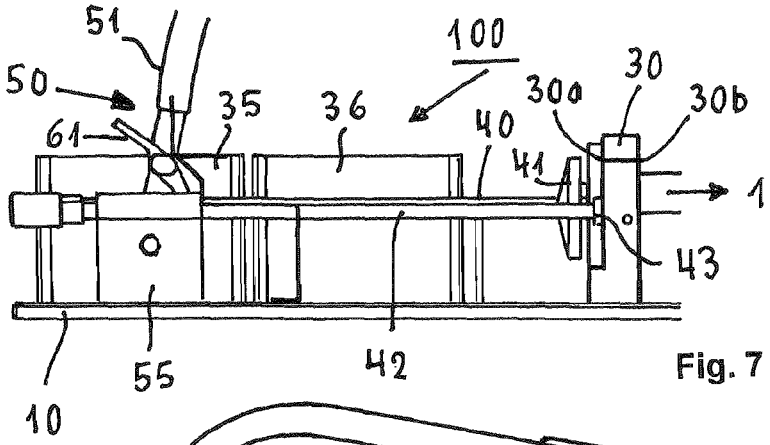
FIG. 7 is a side view of the unit with plungers extended.
Figure 8:
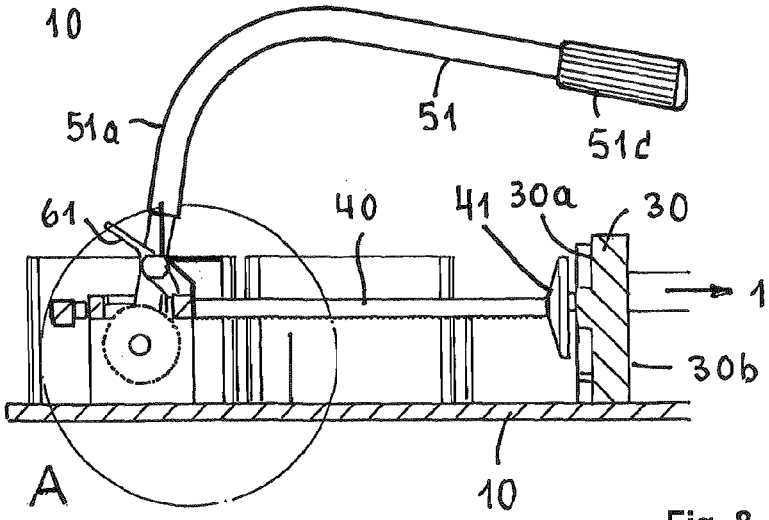
FIG. 8 is a side view of the unit with the drive comprised of actuating lever, safety catch and drive axis for the extended plungers.
Figure 9:
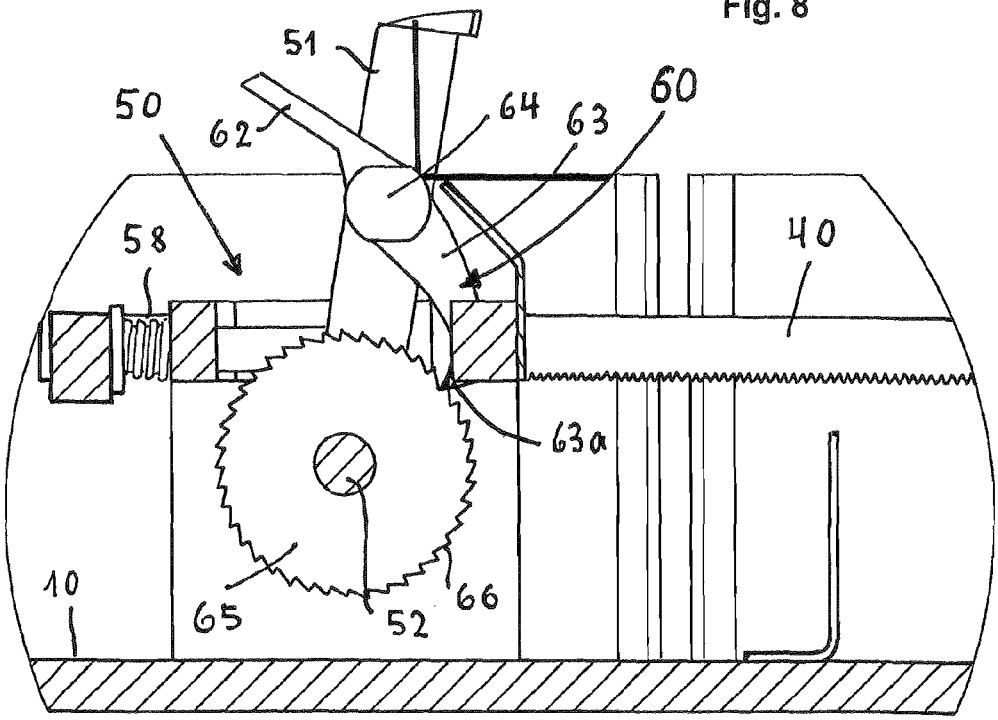
FIG. 9 is a magnified diagrammatic partial view according to A on FIG. 8.

In addition, the free end 51*b* of the angled lever segment 51*a* of the actuating lever 51 is operatively connected with a spring 568, as shown on FIGS. 5 and 9. Moreover, as depicted on FIGS. 5, 8 and 9, the actuating lever 51 is connected with a safety catch 60, which is designed as a two-armed angle lever 61 with lever arms 62, 63, and rotatably arranged at 64 on the actuating lever 51. The free end 63*a* of the lever arm 63 facing the drive shaft 52 is pointed, and with this end engages into a toothed wheel 65 with asymmetrical tooth flanks 66, which is situated on the drive shaft 52 (FIG. 9). The stroke length for advancing the plungers 40, 42 is prescribed by correspondingly setting the angle lever 61 and having the angle lever correspondingly engage into the teeth of the toothed wheel 64 given a preset angular setting of the angle lever 61. This in turn prescribes the quantity of binder component A and curing agent component B that is supplied to the mixing device 1 by advancing the plungers or advancing the plunger plates.

The device 10 further encompasses the mixing device 1 used to mix binder component A and curing agent component B. This mixing device 1 is arranged on the plate side 30*b* of the unit plate 30, specifically between the latter and an electric motor drive for driving the mixing device 1 situated in a housing 70 (FIGS. 1, 2, 3, 10, 11, 12 and 13).

Figure 16:
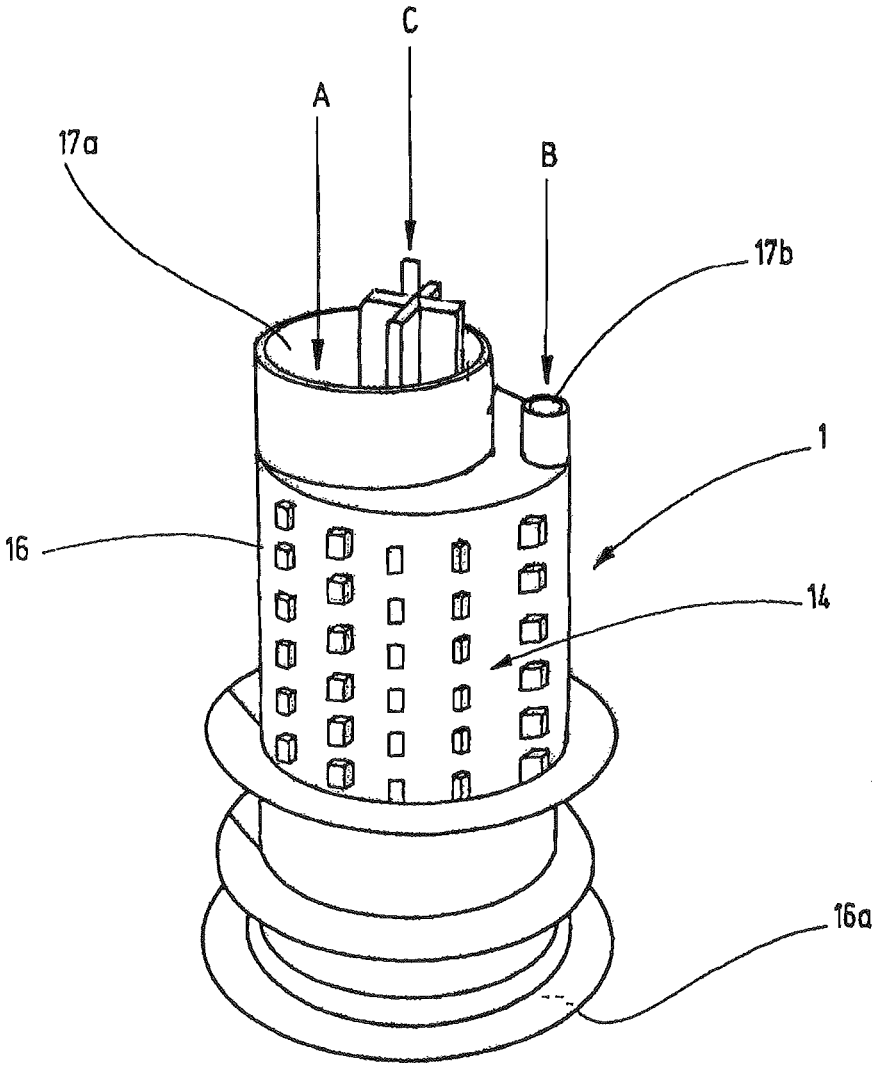
FIG. 16 is a diagrammatic view of the mixing device consisting of the stator section and rotor section, with feeders for the binder component and curing agent component.

The mixing device 1 consists of a fixed stator section 16 and a motorized rotor section 19 incorporated therein, wherein an annular gap comprising the mixing chamber 14 is formed between the two cylindrical parts 16, 19 (FIG. 16, 17).

The mixing device 1 is held and secured between the unit plate 30 and housing 70 for driving the mixing device 1 in such a way that the mixing device 1 can be replaced. The distance between the unit plate 30 and housing 70 for the drive is variable to enable this replacement. This is accomplished by swiveling an actuating lever 71 on the housing 70 (FIGS. 1, 2, 10, 12 and 12). If the actuating lever 71 assumes the position depicted on these figures, the mixing device 1 is coupled to the unit plate 30 in such a way that the adapter-like inlet openings 17*a*, 17*b* for supplying components A and B engage into outlet openings 31*a*, 32*a* of the unit plate 30, and the connection of the rotor section 19 of the mixing device 1 is operatively connected with the drive. By contrast, if the actuating lever 17 is swiveled from position A to position B according to FIG. 1, the established connections are undone, and the mixing device 1 can be removed from the unit 100 for replacement purposes. The separation devices can also exhibit other structural configurations.

The mixing device 1 is detachably mounted to the unit plate 30, in such a way as to match the inlet opening 17*a* for binder component A in the mixing device 1 with the outlet opening for binder component A in the unit plate 30, and simultaneously to match the inlet opening 17*b* for curing agent component B in the mixing device 1 with the outlet opening 32*a* for curing agent component B in the unit plate 30.

Figure 17:
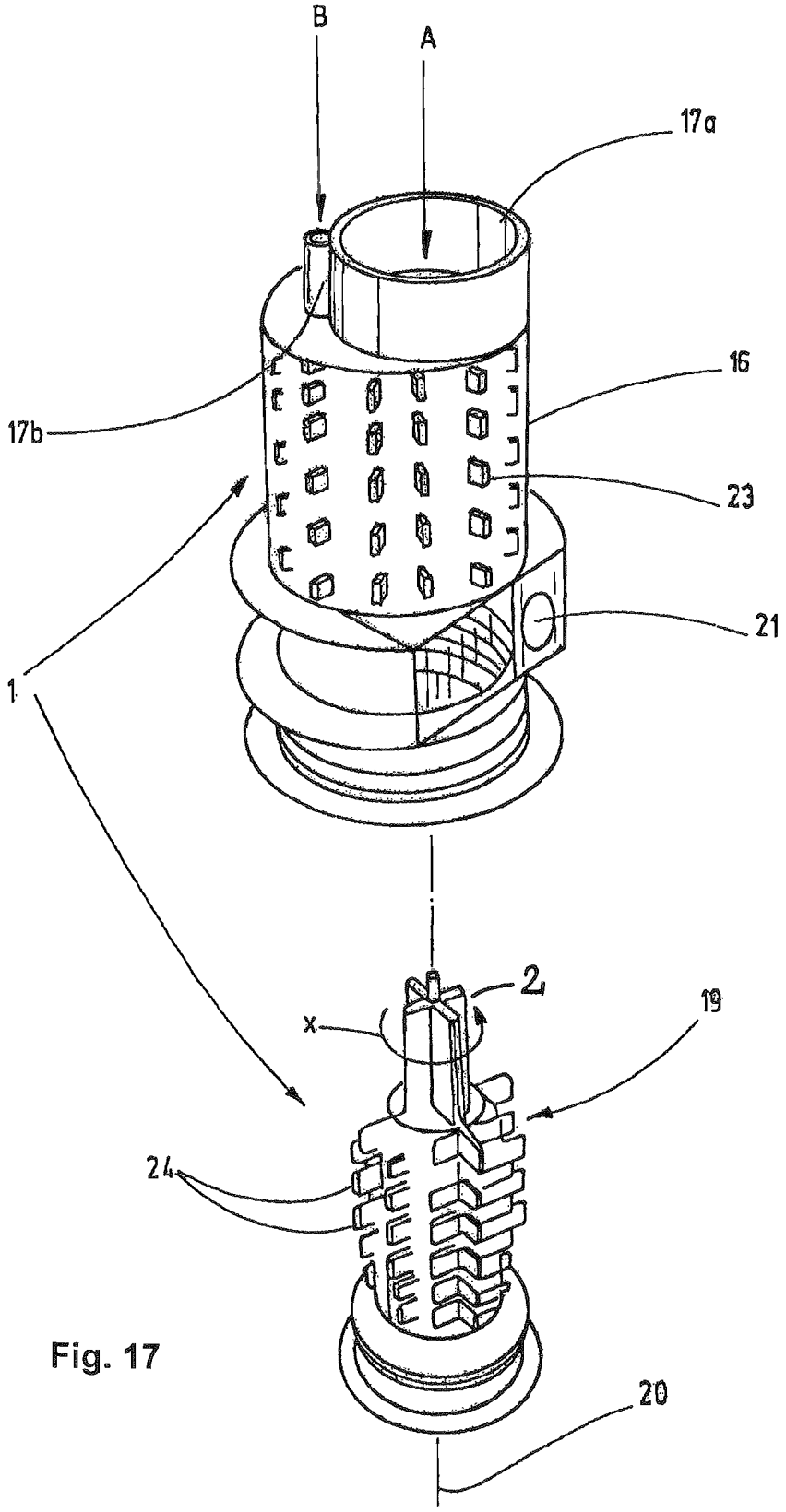
FIG. 17 is a diagrammatic exploded view of the mixing device with the stator section and rotor section according to FIG. 16.
Figure 18:
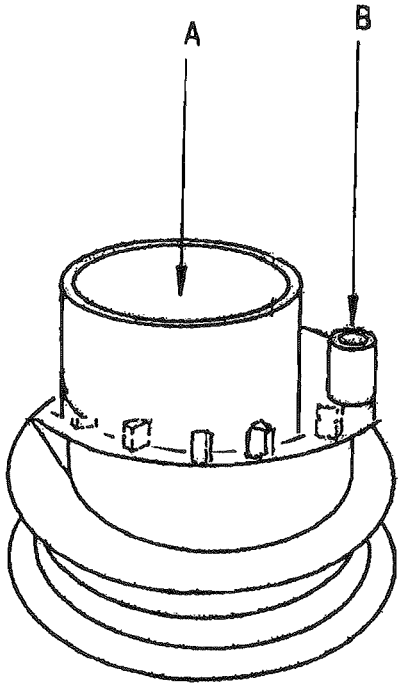
FIG. 18 is a diagrammatic view of the stator of the mixing device with the feeders for the binder component and for the curing agent component.

The mixing device 1 shown on FIGS. 15, 17 and 18 and designed as a disposable component encompasses the stator section 16 and rotor section 19. The rotor section 19 is placed into the stator section 16, and pivoted therein. The drive for the rotor section 19 engages at C (FIG. 16). In order to supply the mixture, the stator section 16 exhibits inlet openings 17*a* and 17*b*, wherein binder component A is supplied through inlet opening 17*a*, and curing agent components B are supplied through inlet opening 17*b*. Respective arrows are marked A and B to illustrate the supply of the two components. The rotor section 19 is mounted so that it can rotate around a longitudinal axis 20, wherein the end side of the rotor section 19 is provided with projections 22, which rotate along with the rotor section 19, and extend into the inlet opening 17*a*. This increases the flowability of the thixotropic binder component A, wherein projections 22 are multiply secured to the end side of the rotor section 19.

The rotor section 19 of the mixing device 1 is driven by means of a driving device, which most preferably involves an electromotive drive, whose drive shaft is designed at its free end in such a way as to enable a coupling with the drive adapter 2 of the rotor section 19 of the mixing device 1 when the mixing device 1 is locked with the unit plate 30.

Components A and B to be mixed are conveyed out of the can-shaped container 90 for binder component A and the cartridge-like container 91 for curing agent component B, through the mixing chamber 14, and to a discharge opening 21 provided on the stator section 16, which in the direction of flow is situated behind the inlet openings 17*a* and 17*b* and after the mixing chamber 14. The stator section 16 accommodates several first mixing teeth 23, which extend radially inward into the mixing chamber 14, while the rotor section 19 accommodates second mixing teeth 24, which extend radially outward into the mixing chamber 14 (FIG. 17).

Figure 12:
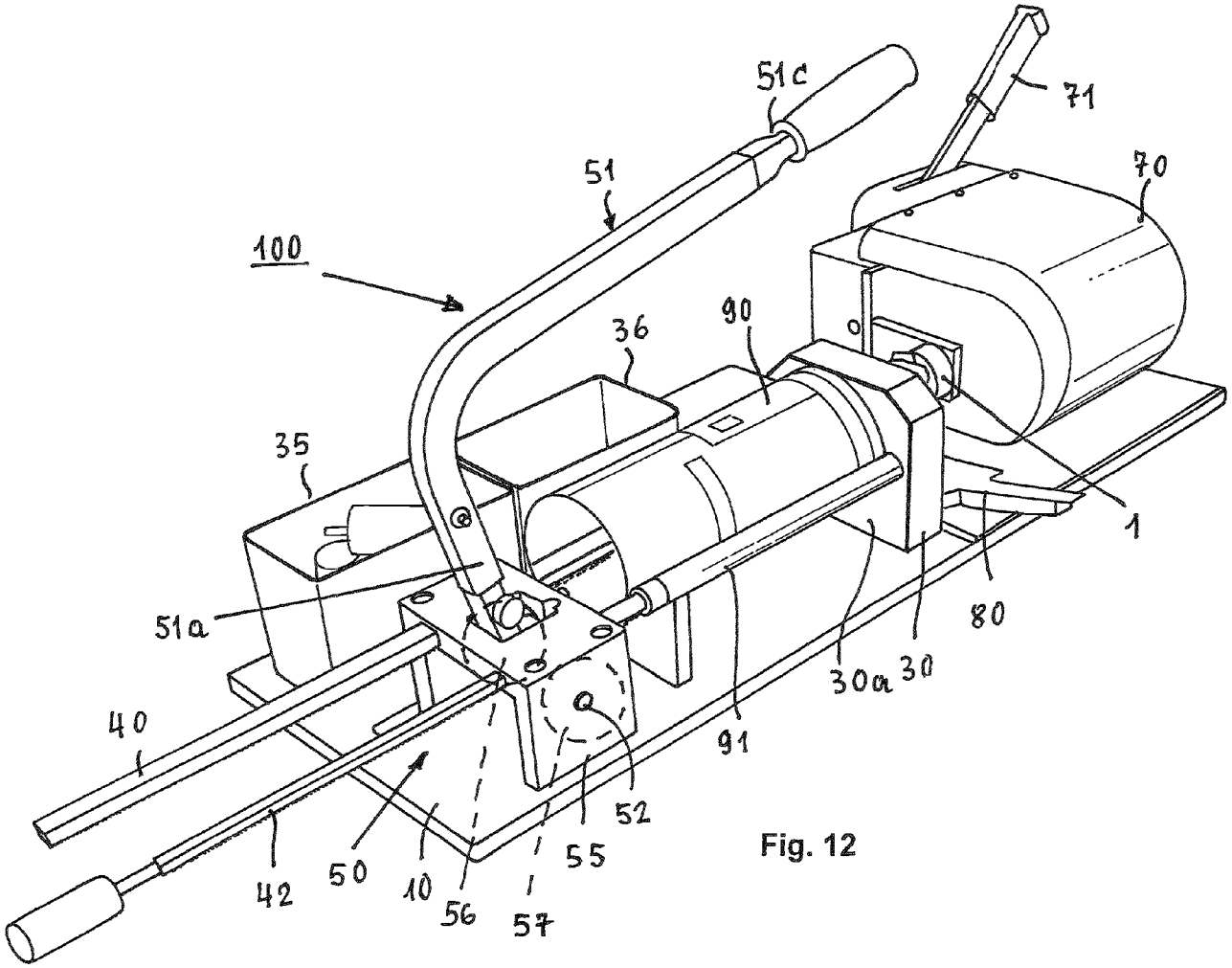
FIG. 12 is another diagrammatic view of the unit.

The manufactured filler can be removed from the mixing device 1 via the discharge opening 21 of the mixing device. For example, the filler is then dispensed onto a putty knife 8, and can in this way be transported for further processing the filler (FIGS. 12 and 13).

As a consequence, a rotational movement by the rotor section 19 in the stator section 16 moves the mixing teeth 23, 24 against each other, thereby causing the two components A and B to become mixed together. For example, once an advance feed of curing agent component B has already taken place, a portion of the ensuing binder component A has been mixed with curing agent component B, and the two other components A and B have been forced into the mixing chamber 14, the continued supply of curing agent component B can be discontinued. The binder component A and curing agent component B fed into the mixing chamber 14 are then mixed together. These two components A and B are fed into the mixing chamber 14 at a prescribed ratio until such time as the respectively desired quantity of mixture is obtained.

The supply of the two components A and B is controlled by means of the actuating lever 51 in conjunction with the hand drive 50.

As shown on FIGS. 3, 4, 10, 11, 12 and 13, the unit plate 30 accommodates two vessels 35 and 36 for holding unused and used mixing devices 1.

In order to be able to monitor the supply of curing agent component in a visual inspection, it is provided that at least the stator section 61 be made out of a transparent material, wherein the transparent material is selected from the group comprised of plastics, encompassing a polycarbonate (PC), a polymethyl methacrylate (PMMA) and/or a styrene acrylonitrile (SAN) or PP in random quality, preferably see-through. It is here further especially advantageous to have the curing agent be visible, so that the operator can monitor the supply of curing agent component with the naked eye during the operation of the mixing device.

The rotor section 19 is advantageously made out of polyoxymethylene (POM), also referred to as polyacetal or polyformaldehyde. This material exhibits better antifriction properties with a polycarbonate or polypropylene (PP).

After each use, the mixing device 1 is replaced with a new mixing device.

A switch 59 is situated at the free end 51*c* of the tubular actuating lever 51 for activating and deactivating the electric motor drive for the rotor section 19 of the mixing device 1. The interior space of the actuating lever 51 then accommodates the electrical lines running from the electric motor drive to the switch 59 (FIG. 1).

Figure 10:
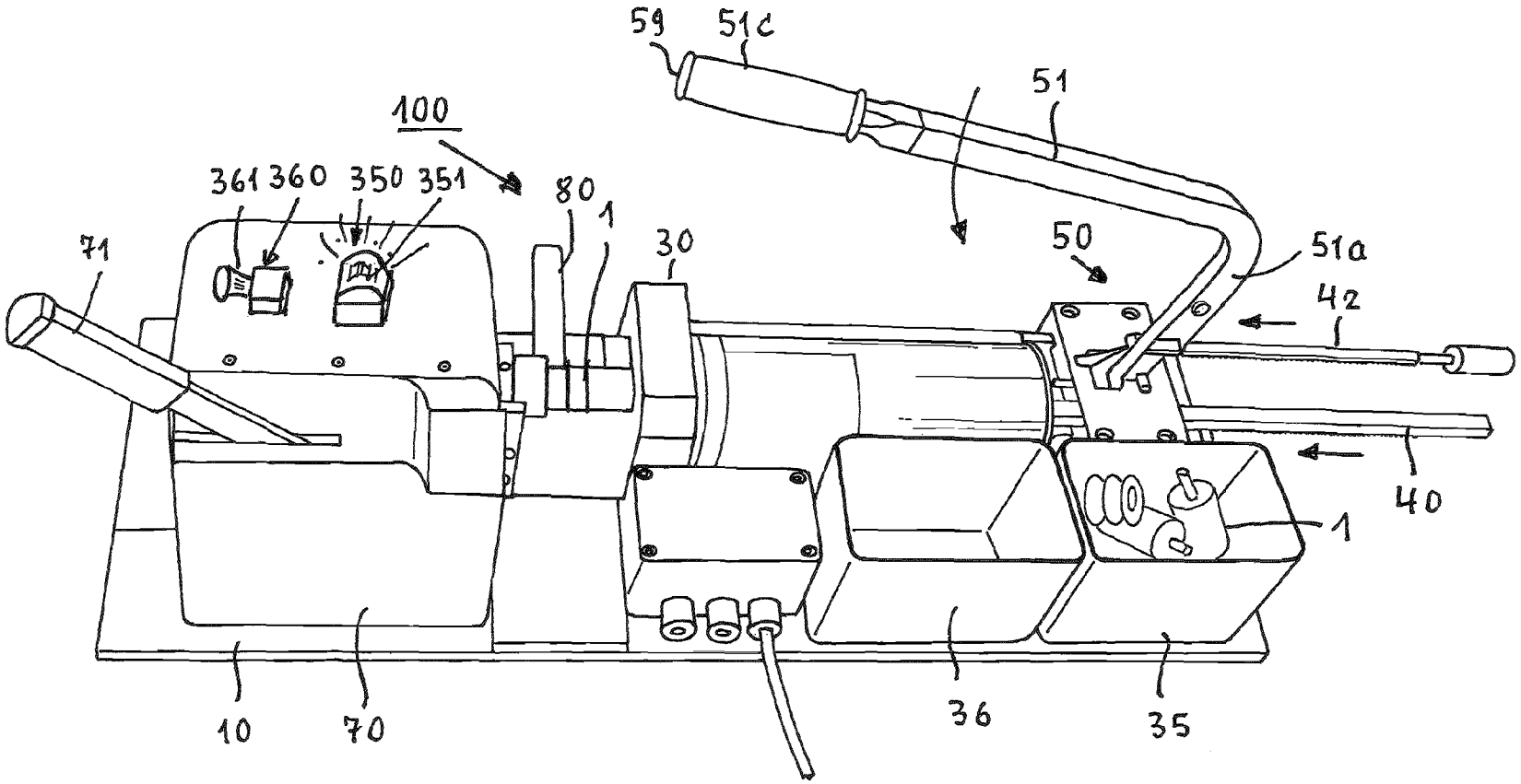
FIG. 10 is a diagrammatic top view of the unit with inserted containers for the two components and extended plungers, as well as with the mixing device and its drive.
Figure 11:
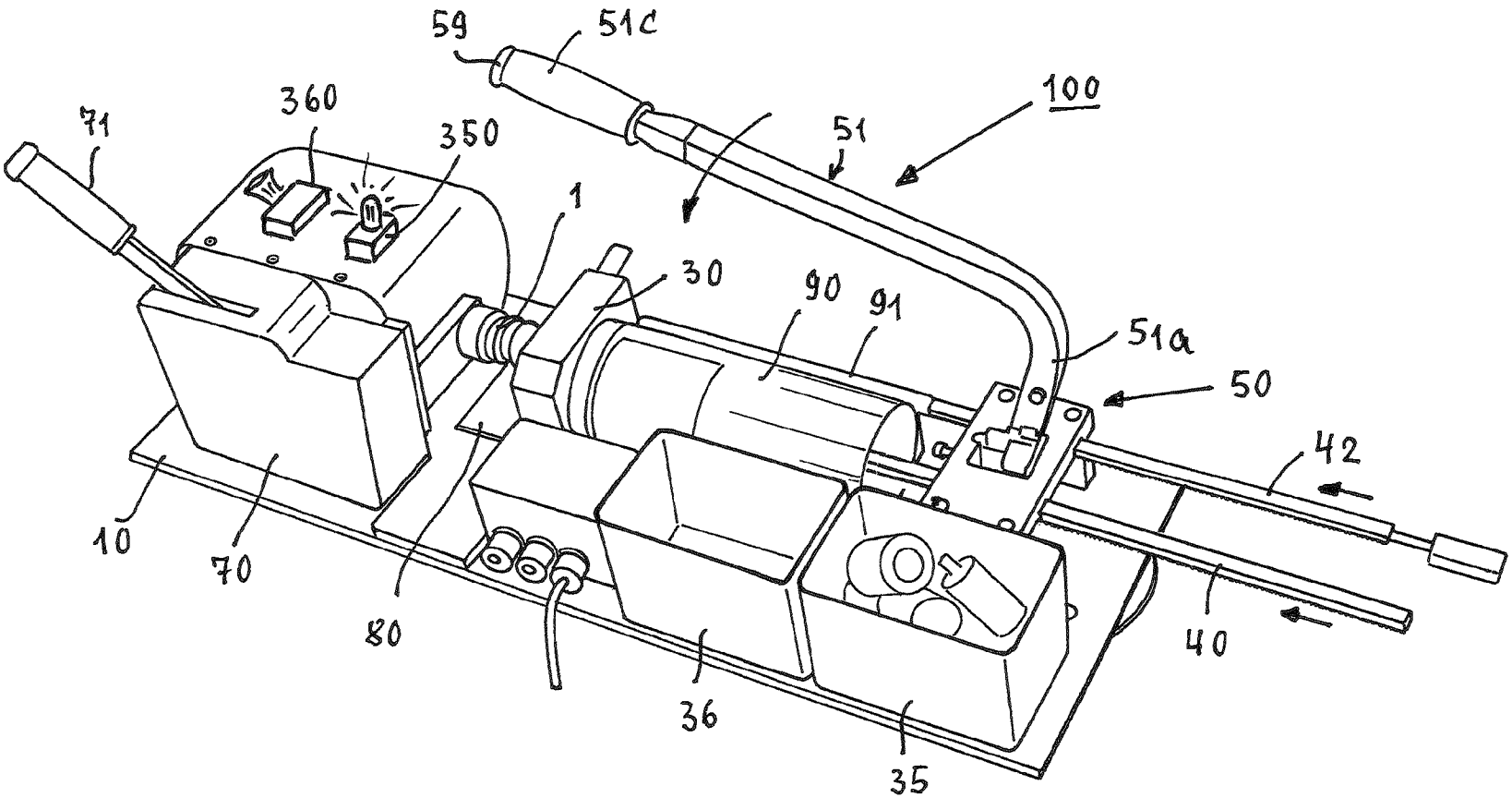
FIG. 11 is another diagrammatic top view of the unit according to FIG. 10.

As shown on FIGS. 2, 10 and 11, an optical signaling device 350 connected with a power source is visibly arranged on the unit 100, and designed as a lamp 351 that emits a white or color light, most preferably a green light. Aside from the optical signaling device 350, the unit component 300 is also provided with an acoustic signaling device 360, which is designed as a bugle or siren 361. The unit 300 can exhibit both signaling devices 350, 360 or just one of the two signaling devices. The optical and/or acoustic signaling device 350, 360 is preferably visibly arranged on the housing 70 for the drive of the rotor section 19 of the mixing device 1.

Both signaling devices 350, 360 are designed and operatively connected with the activator and deactivator for commissioning the unit 100 in such a way that, when commissioning the unit for manufacturing the filler, the signaling devices or just one of the two signaling devices is activated and made operational for a prescribed time, i.e., for example, the acoustic signal sounds and the green signal lamp of the optical signaling device 350 illuminates for a period of two or three minutes, so that other persons in the workshop still have time to tap filler with the unit, specifically for as long as the acoustic signal sounds and/or the light of the optical signaling device 350 stays on. Once the manufacturing process for the filler is complete, the signaling devices 350, 360 are simultaneously deactivated. The signaling devices are only reactivated when a new manufacturing process is initiated and the unit 100 is turned on. The timeframe in which the signaling devices are activated can be individually adjusted, and will depend on the quantity of respective filler to be manufactured.

The unit 100 for mixing at least two components, specifically a binder component A and curing agent component B, encompasses the can-shaped container 90 for binder component A and a cartridge-like container 91 or 92 for curing agent component B (FIG. 3).

Figure 22:
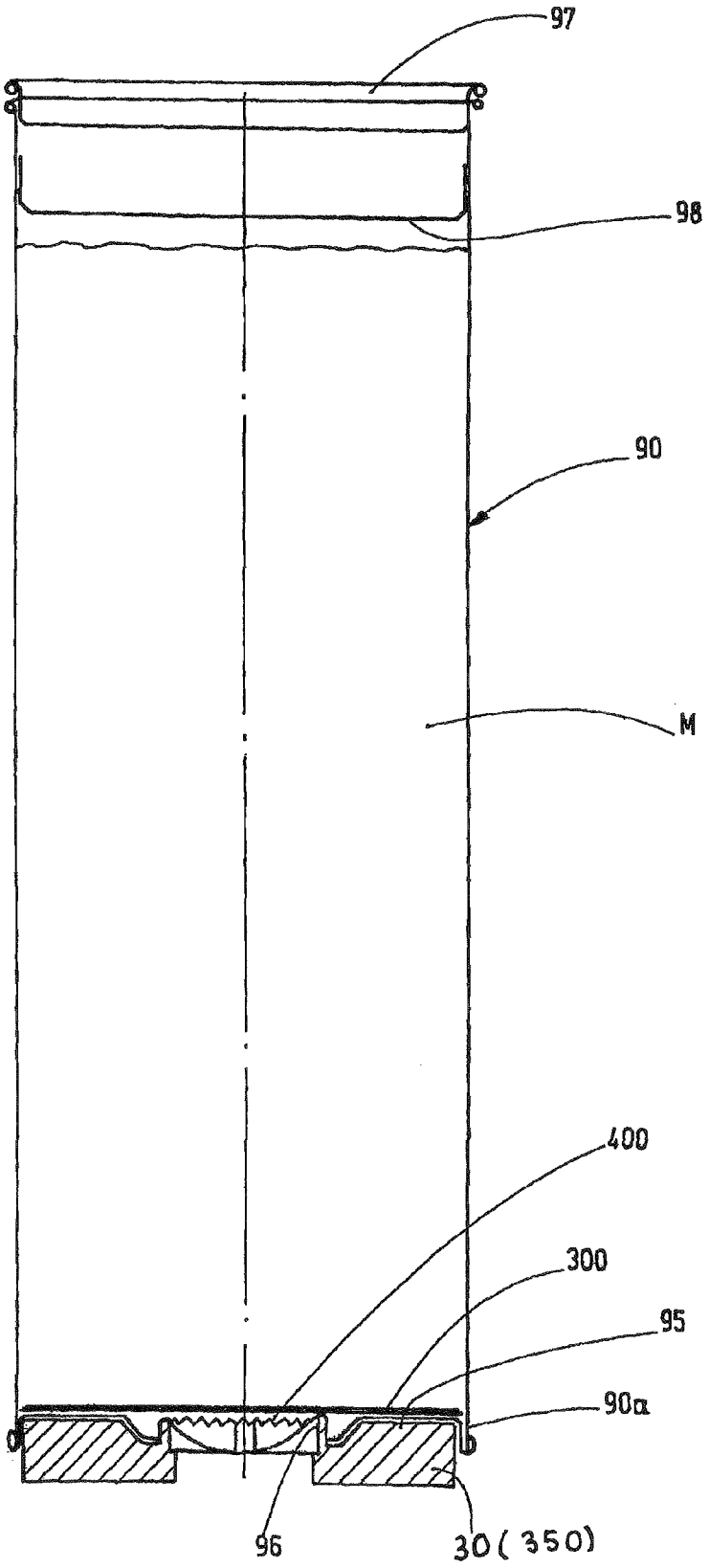
FIG. 22 is the can-shaped container for the binder component placed on the unit plate of the unit for mixing two components, with a cutting device situated in the area of the outlet opening closed by a film, shown partially in projection, and partially in a perpendicular view.

The can-shaped container 90 for binder component A exhibits a cylindrical shape with a circular cross section, and forms a continuous edge 90*a*, and a retracted floor plate 95 with an outlet opening 96 that can be centrally or eccentrically positioned in the floor plate 95 (FIG. 22). Its upper region is closed only for transport, but open during use. The floor of the can-shaped container 90 is closed by means of a floor plate 95. The floor plate 95 exhibits the outlet opening 96.

The can-shaped container 90 is closed for transport by a cover 97, which is removed for use. The interior space of the container 90 can incorporate a sliding floor 98, which is situated above the compound M in the can-shaped container 90, and can be pressurized by means of mechanical, hydraulic or electromotive systems to force the compound out of the container (FIG. 22). If the can-shaped container 90 is provided with a sliding floor 98, then plungers 40, 42 with plunger plates 41, 43 do not have to be used.

The interior wall surface 95*a* of the floor plate 95 accommodates a film 300, which closes the outlet opening 96 (FIGS. 22, 23, 24 and 25). The film 300 can extend over the entire surface of the floor plate 95, but also cover only the outlet opening 96. The diameter of the outlet opening 96 most preferably measures 32 mm or 42 mm.

The can-shaped container 90 is designed as a cylindrical molded body, and preferably has a rated capacity of about 3 liters, although use can also be made of can-shaped containers with other capacities. The can-shaped container 90 most preferably exhibits a circular cross section, but other cross sectional shapes are also possible. The outlet opening 96 formed in the floor plate 94 exhibits a circular cross section (FIGS. 22 and 28), wherein other cross sectional shapes are possible as well.

Figure 23:
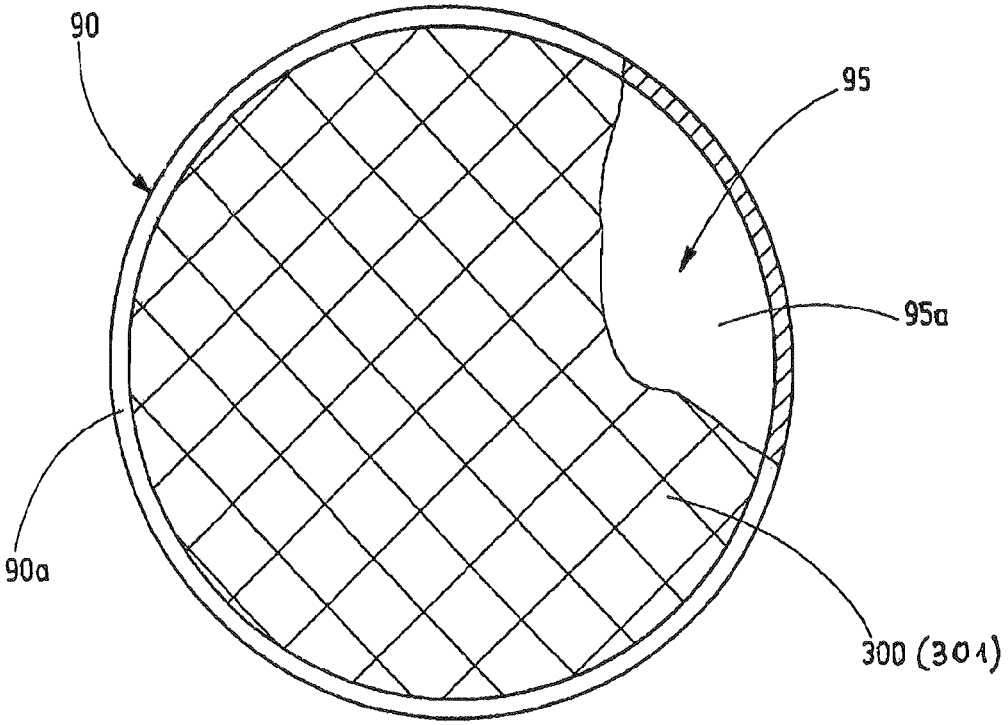
FIG. 23 is a top view of the can-shaped container for the binder component with a film that is situated on the container floor and closes the outlet opening provided on the container floor.
Figure 28:
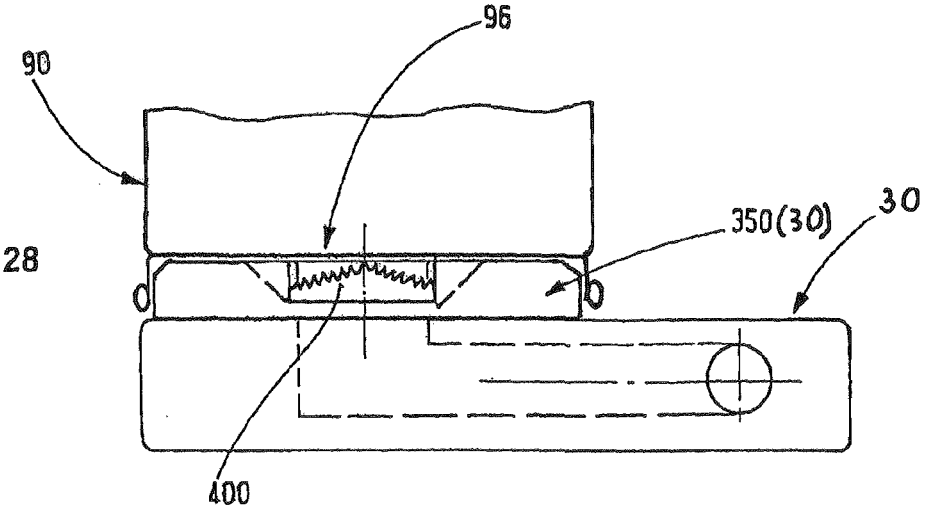
FIG. 28 is the floor section of the can-shaped container placed on the unit plate of the unit, shown partially in projection, and partially in a perpendicular view.

The film 300 is welded or adhesively bonded to the interior wall surface 95*a* of the floor plate 95 so as to cover the outlet opening 96, and consists of plastic or another suitable material that can be cut or ripped open (FIGS. 23 and 28).

Figure 24:
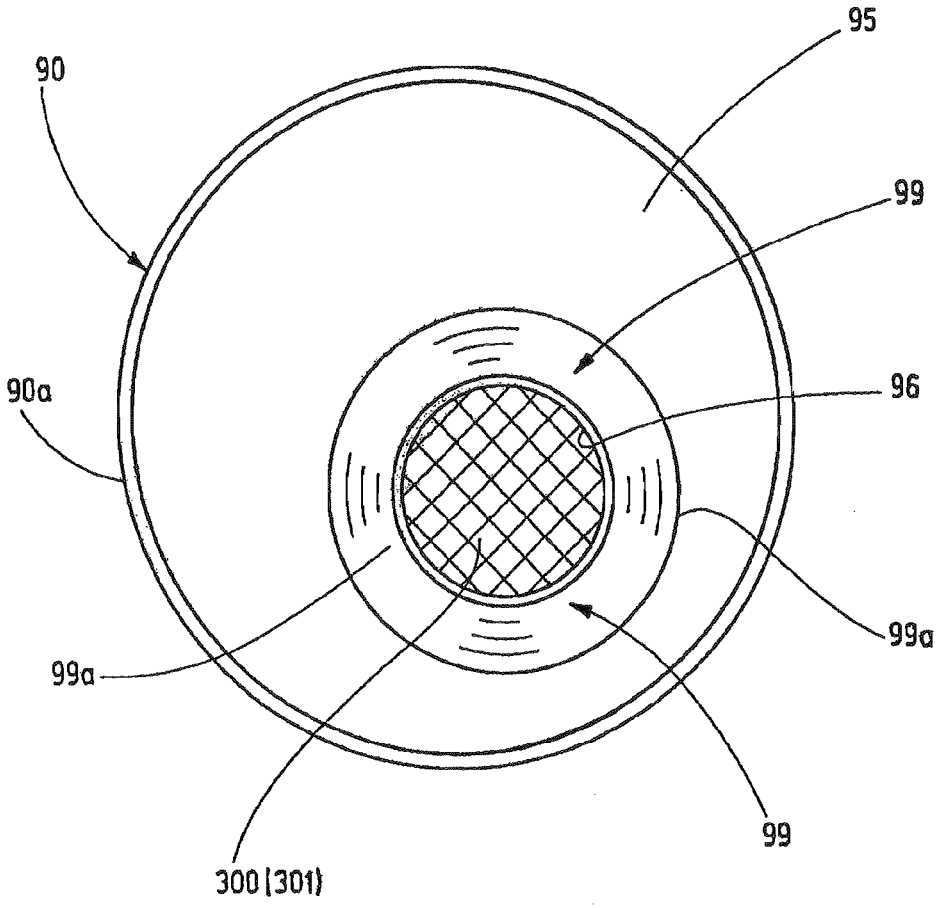
FIG. 24 is a bottom view of the can-shaped container for the binder component, with an outlet opening resembling a spout that is closed by the film.

In the area of the outlet opening 96, the exterior wall of the floor plate 95 exhibits an outlet adapter 99 with a conically running exterior wall surface 99*a* (FIG. 24). If the container 90 is placed on the unit plate 30, the outlet adapter 99 is introduced into the inlet opening 31 of the unit plate 30 (FIGS. 19, 20, 21, 24 and 29).

The region of the outlet opening 96 of the can-shaped container 90 incorporates a knifelike cutting device 400 that functionally acts on the film 300 in the area of the outlet opening 96 while binder component A is extruded from the can-shaped container 90, so as to cut into or perforate and open the film 300 for purposes of releasing the outlet opening 96 of the can-shaped container 90 so binder component A can exit (FIGS. 19, 20 and 22).

The size and dimensions of the film 300 correspond to the size and dimensions of the interior wall surface 95*a* of the floor plate 95. It is also possible to arrange just a film section in the area of the outlet opening 96, in the floor plate 95 of the can-shaped container. Such a film section is dimensioned to be somewhat larger than the surface of the outlet opening 96, and is adhesively bonded to the interior wall surface 95*a* of the floor plate 95 in the edge region of the outlet opening.

Figure 25:
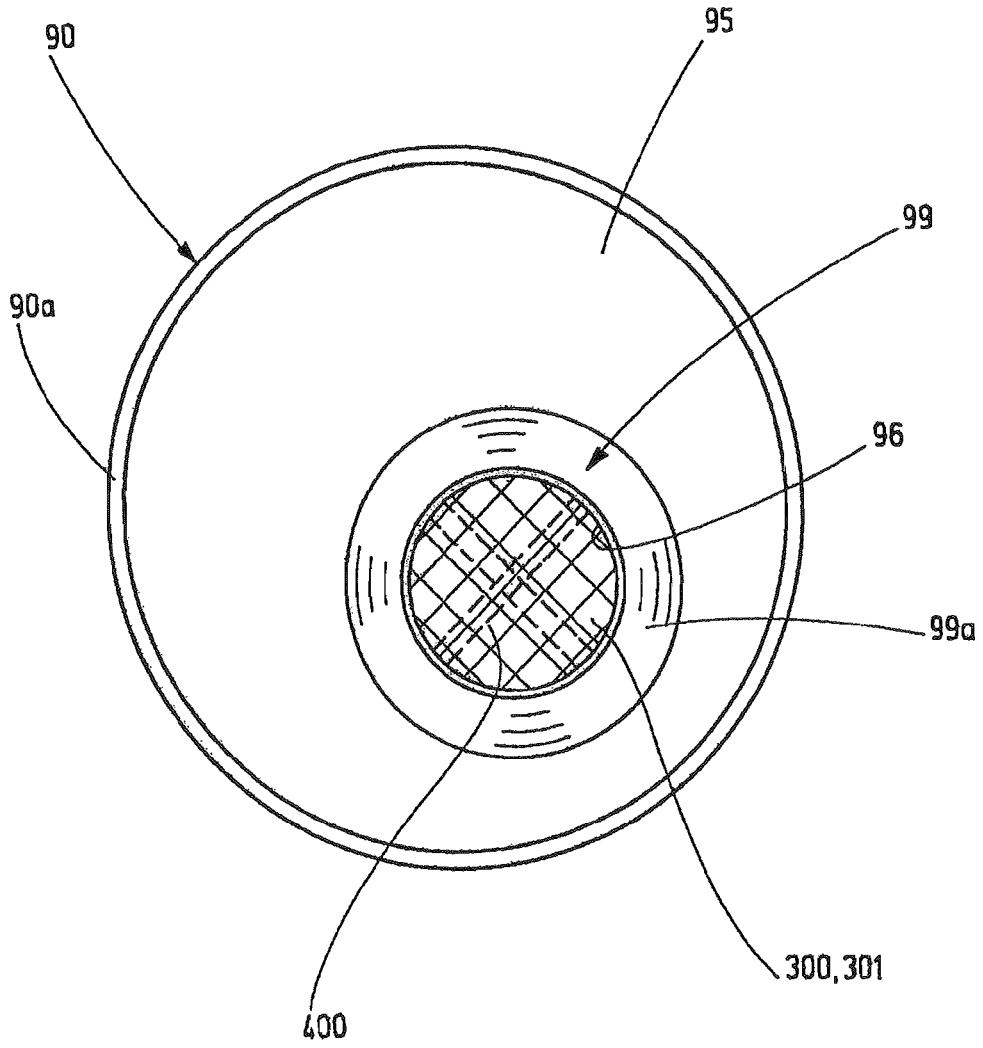
FIG. 25 is a bottom view of the can-shaped container for the binder component, with an outlet opening closed by the film, having a cutting device comprised of two crossed cutters situated under the film.
Figure 26:
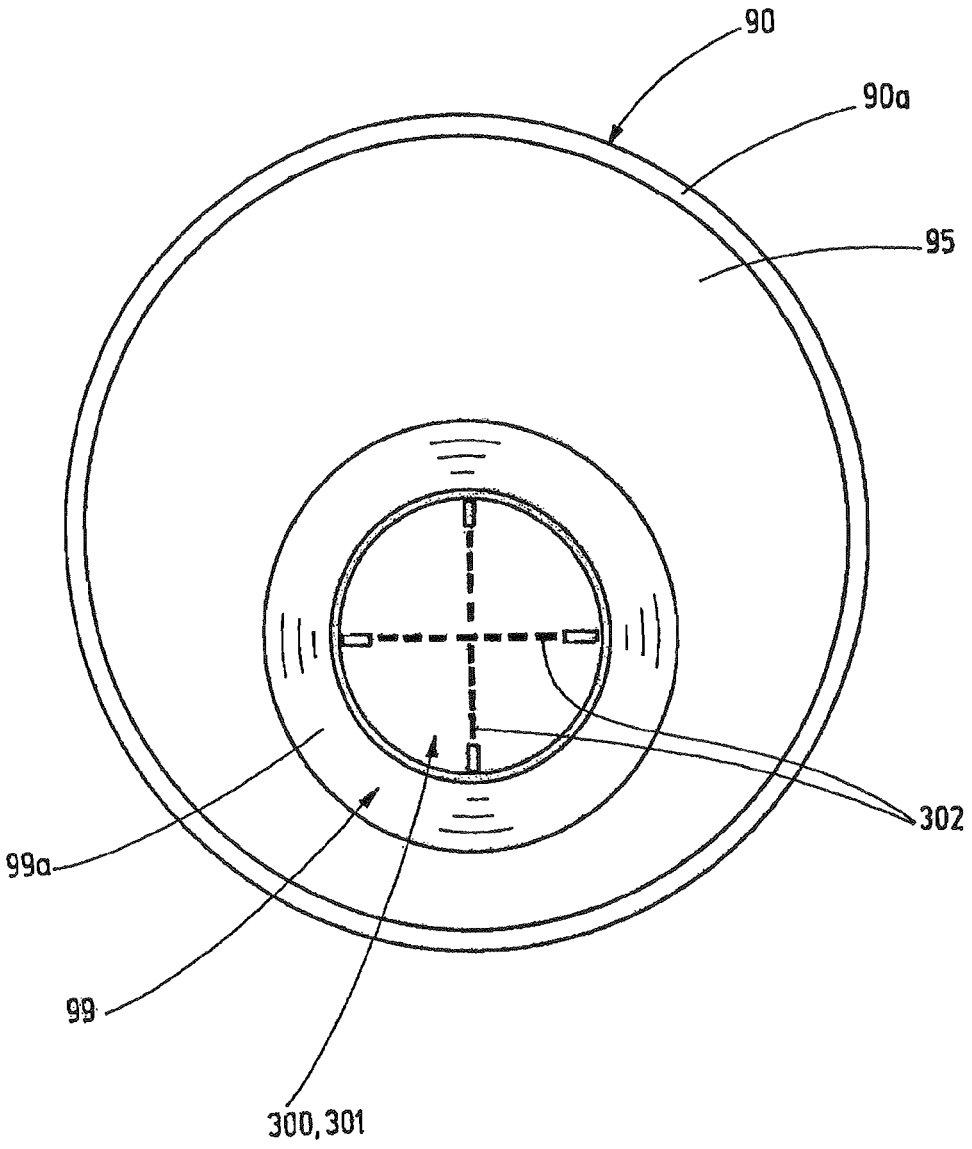
FIG. 26 is a bottom view of the can-shaped container for the binder component, with a cross-shaped perforation of the film closing the outlet opening of the container generated by the tooth-like cutting device.

The cutting device 400 is situated in the area of the outlet opening 96 of the can-shaped container 90 in such a way as to ensure a cutting and separating function of the film section 301 that closes the outlet opening. As a consequence, the cutting device 400 can be an integrated component of the can-shaped container 90, and is most preferably arranged in the interior space of the outlet adapter 99 (FIG. 25).

Figure 27:
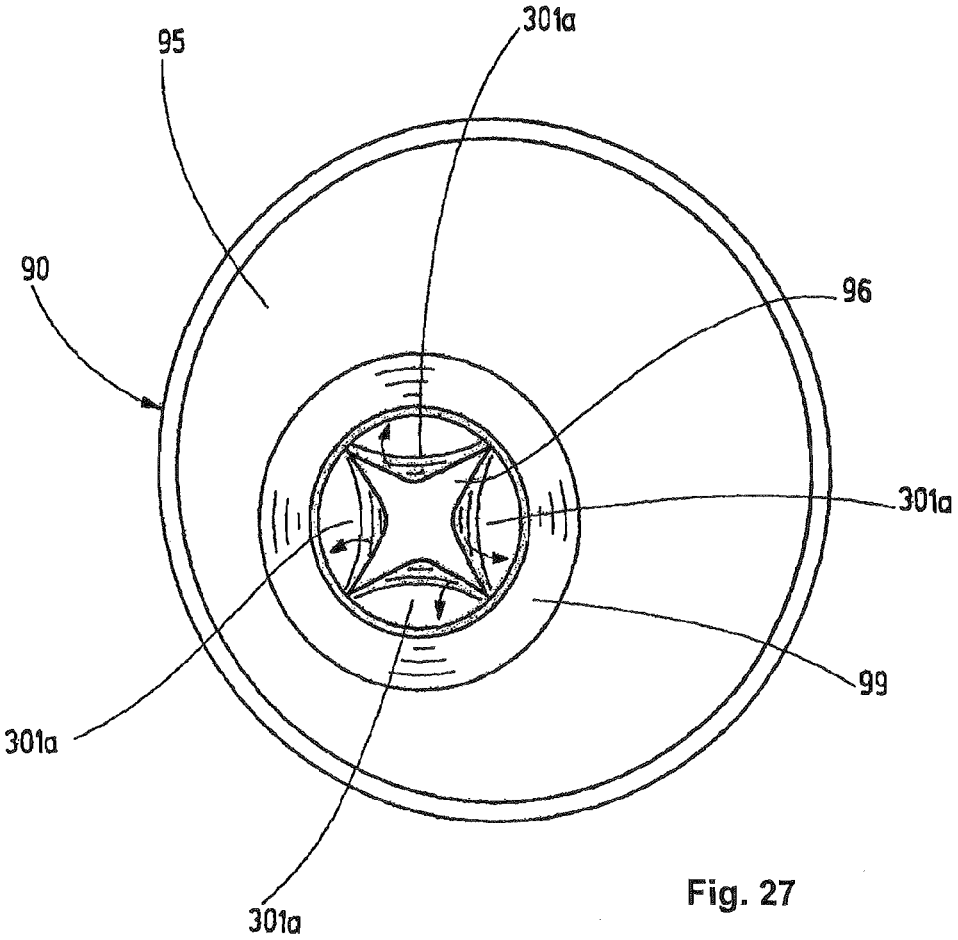
FIG. 27 is a bottom view of the can-shaped container for the binder component with the film cut open.
Figure 29:
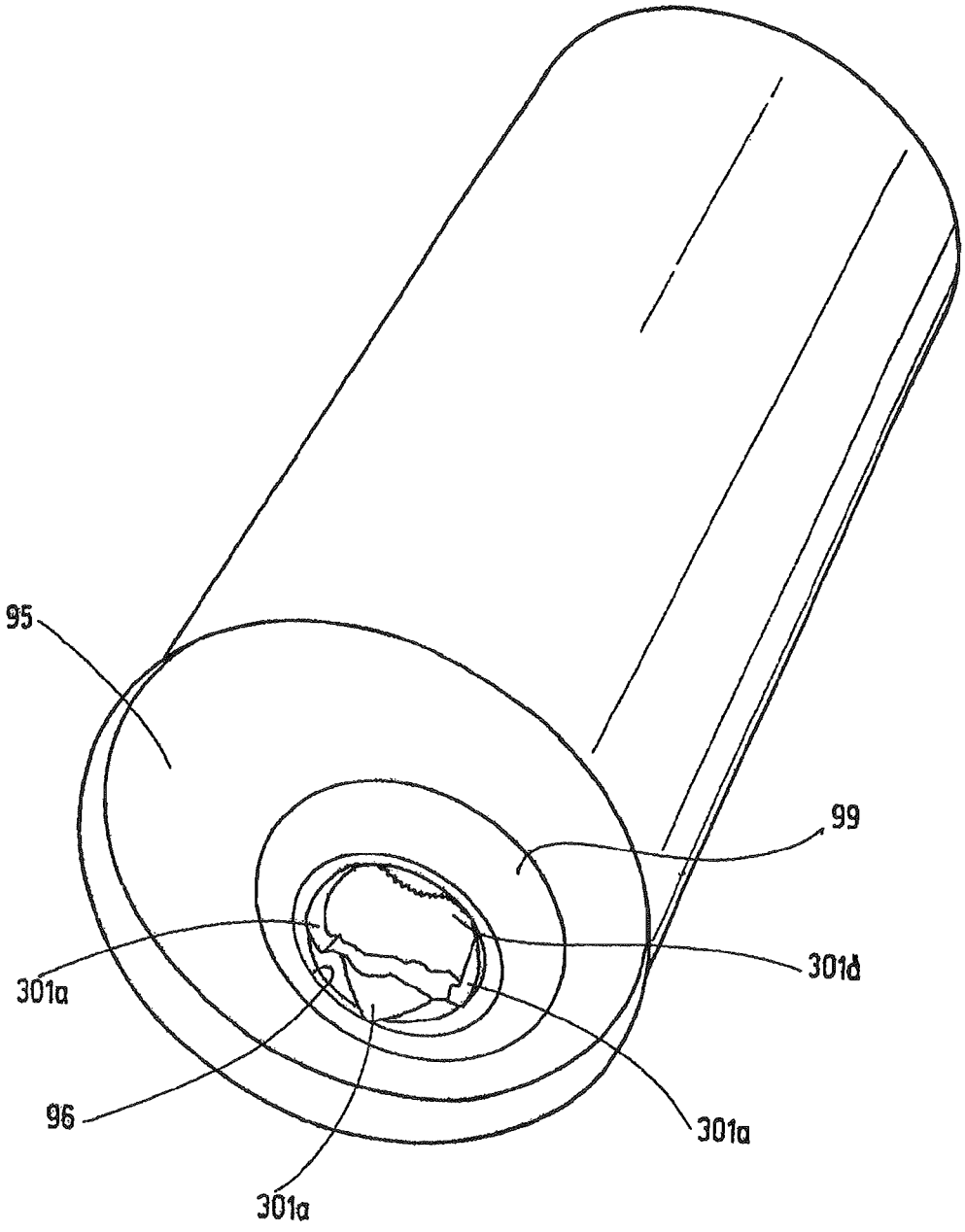
FIG. 29 is a diagrammatic, floor-level view of the can-shaped container with the film cut open in the area of the container outlet opening.

The cutting device 400 consists of at least one knifelike or serrated molded body 401, with knifelike cutting or saw teeth 403 facing the outlet opening 96 of the can-shaped container 90 (FIGS. 30 and 31), wherein the cutting or saw teeth 403 are situated at a very slight distance away from the film section 301 that closes the outlet opening, or act upon the latter without damaging the film section 301 in the process. The following function is achieved as a result: Increasing the internal pressure of the filler during the first extrusion process causes the film section 301 to bulge in the direction of the teeth comprising the cutting device 400, and come into contact with the teeth in the crossed blades of the cutting device 400, so that the plurality of teeth produce an indentation. The film of film section 301 starts to rip in the middle, so that four flap-like film sections 301*a* form, and are bent away (FIG. 27 and FIG. 29). These four bent flap-like film sections 301*a* thereby release an opening, thus allowing a sufficient quantity or respectively required quantity of the relatively viscous compound of binder component A to pass or flow through the opening thusly formed by the bent, flap-like film sections 301*a*. An indentation having the effect of ripping open a hole only takes place at an internal pressure starting at 2 bar, since the film that covers the outlet opening 96 of the can-shaped container 90 must be thick enough to withstand the normal levels that can be encountered while transporting the can-shaped container 90 without becoming damaged, or detracting from the impermeability in the process. It is also possible to design the exterior wall surface of the outlet adapter 99 on the floor plate 95 of the can-shaped container in such a way as to place a protective cover on the outlet adapter 99, where it is held in place by way of a force fit.

Use is most preferably made of a corrugated film 300, e.g., consisting of plastic, and having a thickness of about 0.04 mm, although other thicknesses can also be used. When using a corrugated film 300, the film corrugation provides the option of forming an arc, so that it can rest against the teeth of the cutting device 400.

According to FIGS. 30 and 32, the cutting device 400 consists of two crossed, serrated molded bodies 401, 402 with saw teeth 403 that are connected with each other or inserted into each other, wherein each molded body 401, 402 exhibits saw teeth 403 facing the outlet opening 96 of the container 90 (FIGS. 19 and 22), wherein the cutting device 400 according to FIGS. 19 and 20 is an integrated component of the unit plate 30, and situated in the area of the inlet opening 31 of the unit plate.

Figure 39:
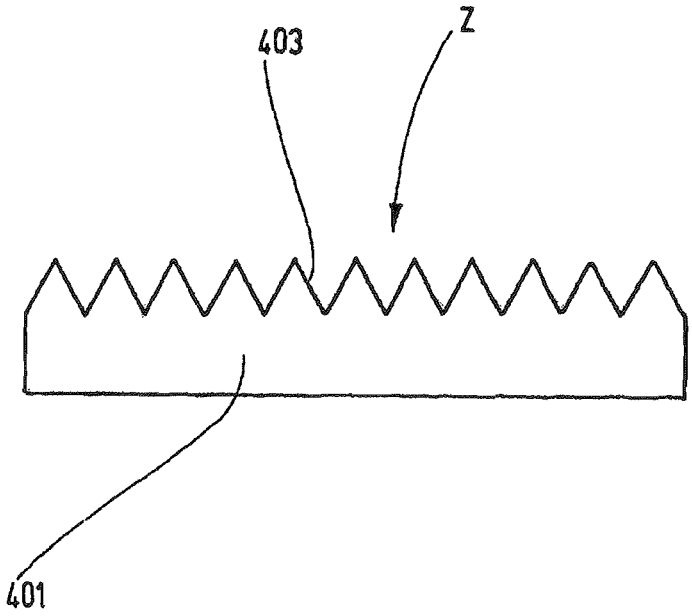
FIG. 39 is a side view of another embodiment of a serrated molded body with a series of saw teeth exhibiting an identical height.

All saw teeth 403 of each molded body 401, 402 exhibit identical heights (FIGS. 30, 31 and 39). The two molded bodies 401, 402 are provided with slotted recesses 401*a* and 402*a* to be inserted crosswise into each other, of which the slotted recess 401*a* extends from the side 401*b* of the molded body 401 facing away from the saw teeth 403 in the direction of the saw teeth, while the slotted recess 402*a* of the molded body 402 extends from the saw teeth in the direction toward the side 401*b* facing away from the saw teeth (FIG. 31). Both slotted recesses 401*a*, 402*a* exhibit a width corresponding to the thickness of each molded body 401, 402. The lengths of the two slotted recesses 401*a*, 402*a* are dimensioned in such a way that, when the two molded bodies are inserted into each other, the lower sides 401*b*, 402*b* lie in a single plane, thereby yielding a cutting device 400 with crossed molded bodies 401, 402 (FIGS. 32 and 33).

In the embodiment according to another configuration of the cutting device 400, each molded body 401, 402 can exhibit a row of teeth, in which every second saw tooth exhibits a greater height relative to the other saw teeth.

The toothed row of each molded body 401, 402 can also exhibit an arced progression.

Figure 35:
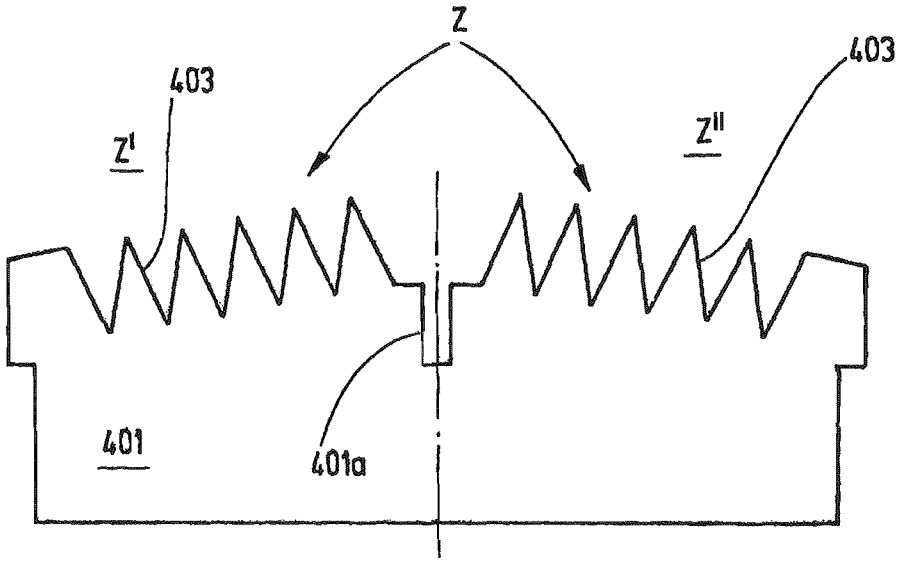
FIG. 35 is a magnified side view of a first serrated molded body with inclined rows of saw teeth that rise toward the middle.
Figure 36:
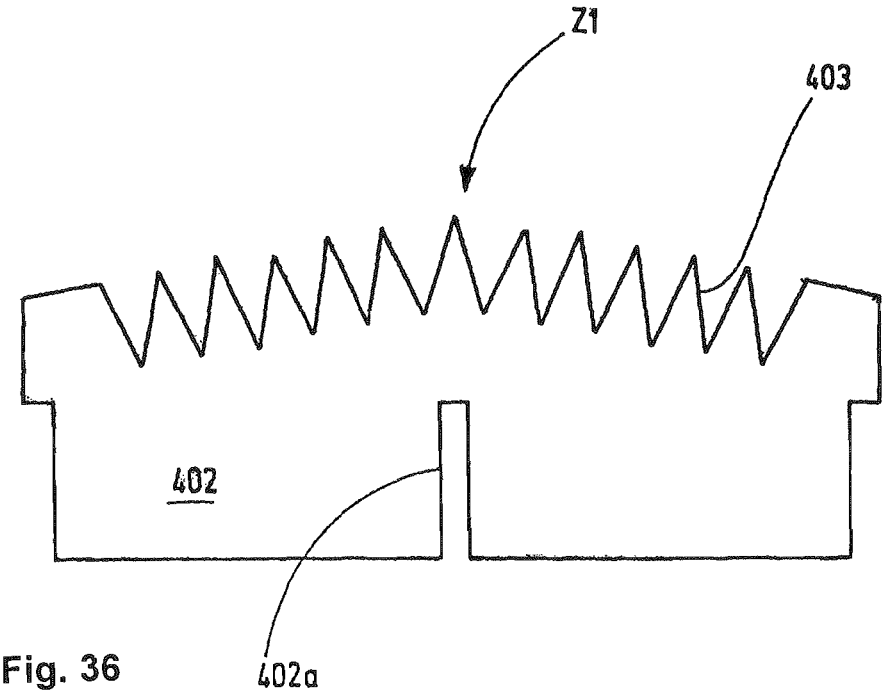
FIG. 36 is a magnified side view of a second serrated molded body with inclined rows of saw teeth that rise toward the middle.

In the embodiment according to FIGS. 34, 35 and 36, each molded body 401, 402 exhibits a row of teeth Z, Z1 consisting of sections Z', Z1' conically extending toward the middle of the molded body 401, 402, wherein the outer end regions of the two rows of teeth Z, Z1 pass over into sharpened, knifelike sections.

Figure 37:
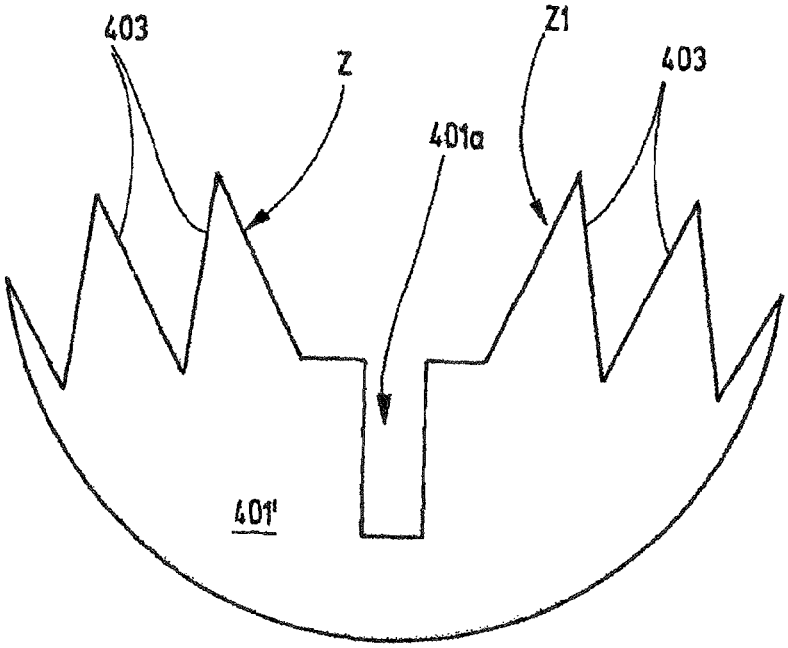
FIG. 37 is a magnified side view of a first, serrated molded body with two rows of saw teeth and outlying teeth of another embodiment that resemble tapered taps.
Figure 38:
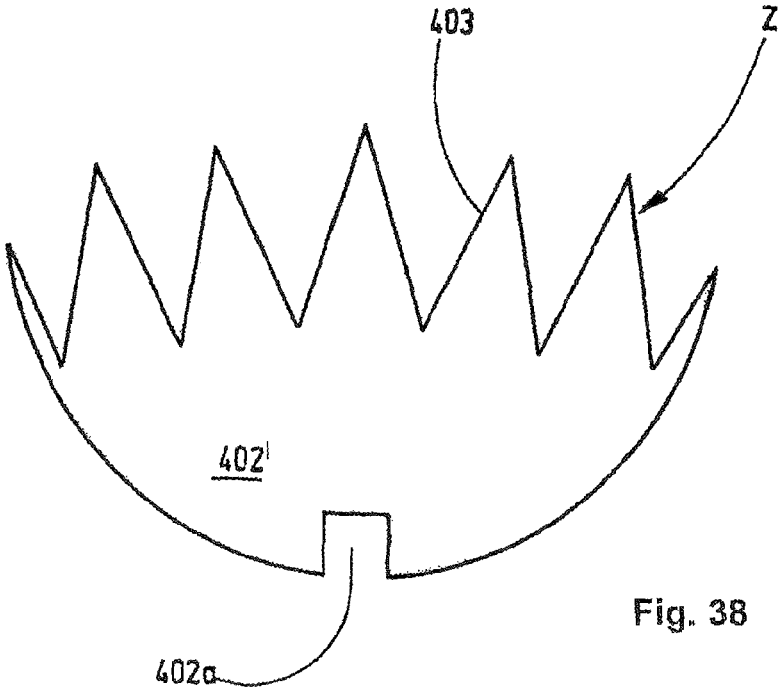
FIG. 38 is a magnified side view of a second, serrated molded body with two rows of saw teeth and outlying teeth of another embodiment that resemble tapered taps.

In another embodiment according to FIGS. 37 and 38, each molded body 401, 402 consists of rows of teeth respectively exhibiting at least two teeth, which conically extend toward the middle of the molded body 401, 402, wherein the outer end region of the two rows of teeth pass over into teeth resembling tapered taps or arrow tips.

The molded bodies 401, 402 and 401', 402' according to FIGS. 35, 36 and 37, 38 are designed in such a way relative to the arrangement of teeth that the slotted recesses 401*a*, 402*a* of the molded bodies 401, 402 according to FIG. 23, 24 and the slotted recesses 401*a*, 402*a* of the molded bodies 401', 402' according to FIG. 25, 26 allow two identically designed molded parts to engage one into the other when the respective molded parts are inserted crosswise into each other. The molded parts 401, 402 differ from the molded parts 401', 402' in that the molded parts 401, 402 proceed from approximately rectangular base plates with the saw teeth, while the molded bodies 401', 402' exhibit semicircular base plates.

Figure 40:
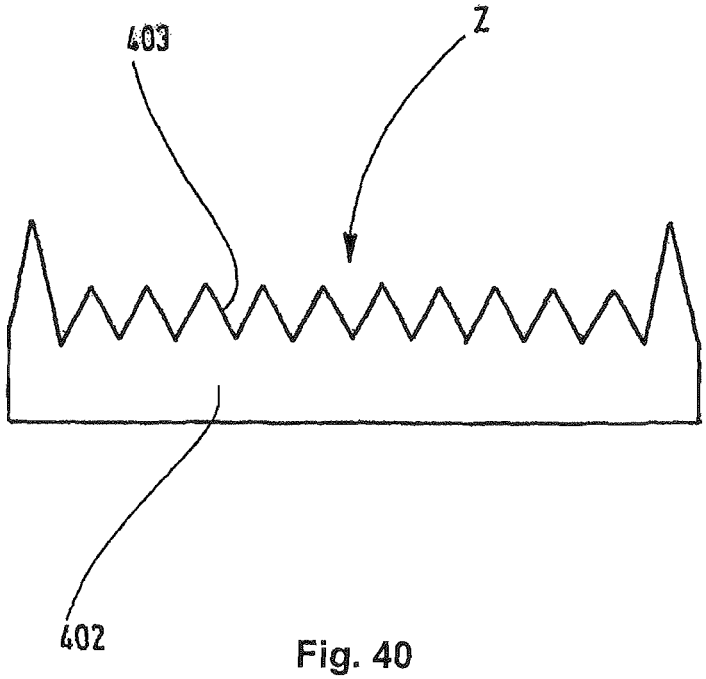
FIG. 40 is a side view of another embodiment of a serrated molded body with a row of saw teeth exhibiting an identical height, and with outlying teeth exhibiting a greater height in relation to the middle teeth of the row of saw teeth.

According to FIG. 19, each molded body 401, 402 can exhibit toothed rows with teeth having the same height. The molded body 401 shown on FIG. 40 exhibits a toothed row with teeth having an identical height or length, wherein the respective outer teeth exhibit a greater height or length in relation to the other teeth in the toothed row. The advantage to the latter configuration is that, when pressing against the film section 301 lying in the area of the outlet opening 96 of the floor plate 95 of the can-shaped container 90, the film in this section is ripped into or perforated in advance by the longer teeth. In a cutting device 400 with crossed, serrated molded bodies, the teeth in the central region of the crossed saw teeth can exhibit a greater height relative to the other teeth.

All teeth in the cutting device 400 are provided with pointed ends, which are partially ground and have sharp edges. Advantageous configurations for the molded bodies 401, 402 or 401', 402' are those in which the teeth in each toothed row extend conically toward the outer center of the molded body. This toothed area impacts the film section 301 first, ripping it open in the middle. FIG. 4 shows the cutting device 400 situated under the film section to be opened, but it can also be arranged in the area of the outlet opening 96 of the floor plate 95. The cutting device 400 is then an integrated component of the can-shaped container 90. If the film section 301 as a whole is pressed against the cutting device while extruding the compound from the can-shaped container 90, the film section is perforated crosswise by the teeth of the crossed molded body 401, 402, 401', 402' (FIG. 5), as a result of which a further exertion of pressure causes the film to be ripped open in the area of the perforation 302, as denoted on FIG. 6. The four roughly triangular sections 401*a* are laterally pushed away by the compound forced out of the can-shaped container 90, thereby releasing the outlet opening 96, allowing the compound to smoothly flow out.

The teeth of the molded bodies 401, 402, 401' and 402' exhibit the shape depicted on FIGS. 30, 31, 23, 35, 36 and 38.

The film 300 consists of plastics, such as PVC. Use can also be made of metalized films or two-component films, e.g., comprised of an aluminum film and plastic film. Because the cutting device 400 perforates the film section 301 lying in the area of the outlet opening 96 in the floor plate 95 of the can-shaped container 90, it is ensured that the film section is ripped open when exposed to pressure exerted by the compound forced out of the can-shaped container 90, i.e., that the plurality of teeth comprising the cutting device 400 yield an indentation, so that the film begins to rip from the middle, producing flap-like sections 301*a* that are bent away and release the opening so that the compound can exit (FIGS. 27 and 29). Both thin films and thicker films can be used, wherein the latter are opened in the same way as thin films by means of the cutting device 400.

The can-shaped container 91 for curing agent component B can be designed just like the can-shaped container 90 for binder component A that is able to functionally interact with a cutting device 400, and also interact with the cutting device 400 configured according to the invention.

Aside from integrating the cutting device 400 into the can-shaped container 90, another embodiment involves arranging the cutting device 400 in the area of the inlet opening 31 of the unit plate 30, as shown on FIGS. 19, 20 and 21. In this embodiment, the inlet opening 31 of the unit plate 30 is provided with a recess shaped like the outlet adapter 99 of the can-shaped container 99, so that the unit plate 30 functions as a support and centering plate. FIGS. 19 and 20 also depict the arrangement of a support plate 350 on the unit plate 30, which is provided with a borehole corresponding to the inlet opening 31. The opening formed in the support plate 350 at the top then exhibits the cutting device 400, and is designed in such a way that the outlet adapter 99 of the container 90 engages into the opening of the support plate 350 with the container 90 fitted. The circumference of the support plate is dimensioned in such a way that its continuous edge 90*a* encompasses the edge region of the support plate 3509 with the container 90 fitted (FIGS. 19 and 22).

As demonstrated, the exterior wall of the floor plate 95 of the can-shaped container 90 exhibits an outlet adapter 99 with a conically progressing exterior wall surface in the area of the outlet opening 96 (FIG. 22). If the can-shaped container 90 is placed on the unit plate 30, the outlet adapter 99 is introduced into the inlet opening 31 of the unit plate 30. The unit plate 30 can also be provided with a trough-shaped depression having a continuous edge, the cross sectional shape of which corresponds to the cross sectional shape and dimensions of the can-shaped container 90, so that the can-shaped container 90 can be placed inside the depression and thereby firmly take hold, wherein the outlet opening 96 in the floor plate 95 of the can-shaped container 90 then corresponds, i.e., is congruent, with the inlet opening 31 of the unit plate 30 if the can-shaped container 90 is placed in the depression. It is also possible to provide the unit plate 30 with circularly arranged cam-like brackets in the area of the inlet opening 31, with which the can-shaped container 90 is held in place.

As a consequence, the invention relates to a unit 100 for mixing together two components A and B filled into containers 90, 91 to manufacture a ready-to-use filler to fill surfaces, for example of vehicle bodies, as described above, claimed and shown on the drawings, and encompasses a hand drive 50 for manually driven plungers 40, 42 provided at one end with plunger plates 41, 43 to force components A and B out of the containers, and feed the components into a mixing device 1, wherein the hand drive 50, containers and mixing device 1 are situated on a horizontal base plate 10.

Figure 41:
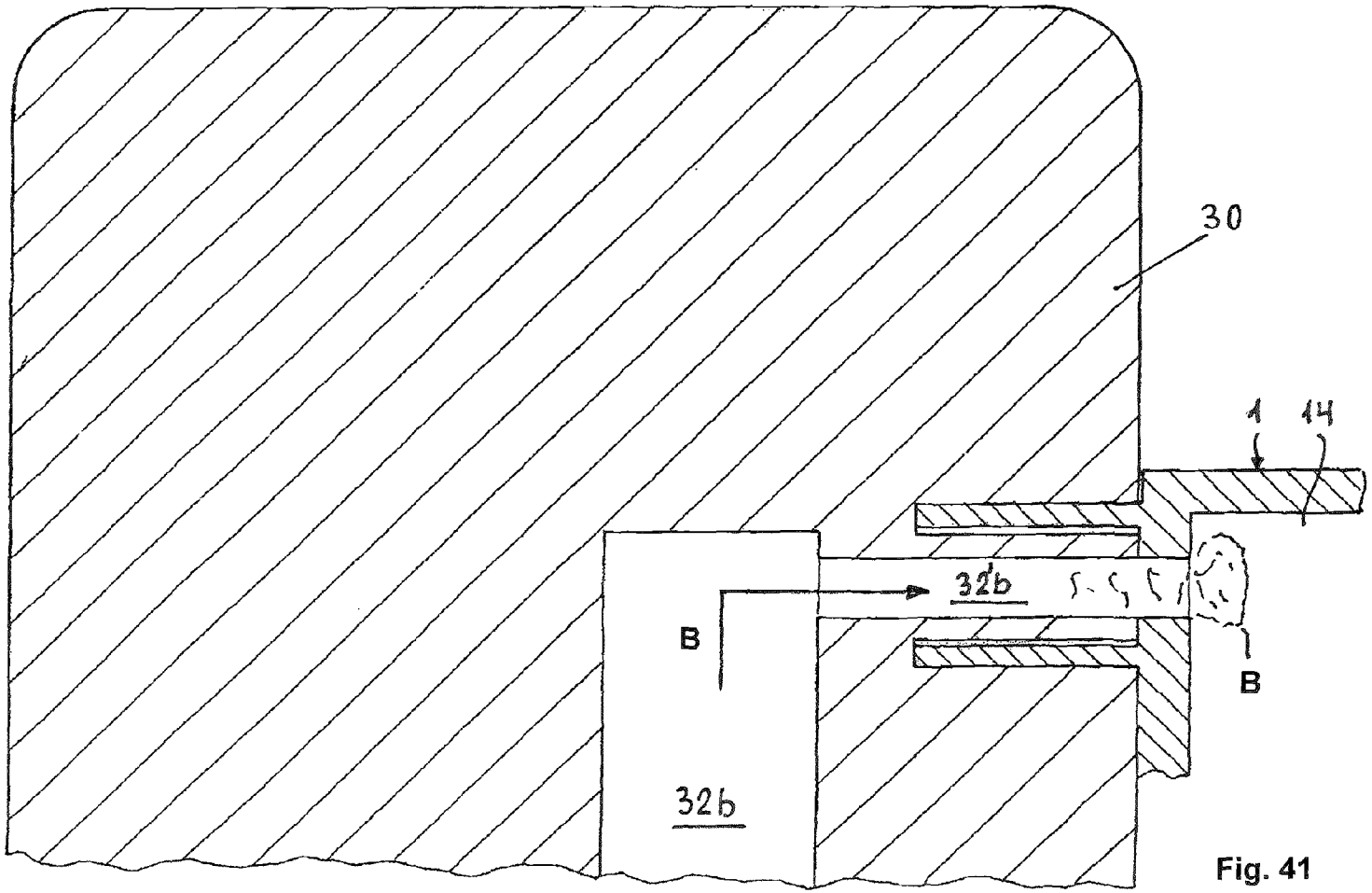
FIG. 41 is a perpendicular section of a segment of the unit plate with a feed channel for the curing agent component having a feed channel section exhibiting a smaller diameter, and with an attached mixing device.

FIGS. 14 and 15 show views of the plate-like unit plate 30 with the inlet openings 31, 32 for binder component A and curing agent component B, as well as the outlet openings 31*a*, 32*a* for the two components A and B. The inlet openings 31, 32 are connected with the outlet openings by feed channels 31*b*, 32*b* running inside the unit plate 30. The two components A and B flow through the feed channels 31*b*, 32*b* from the containers 90, 91 to the mixing device 1 in the direction of arrow x, y (FIG. 14). In the area of inlet openings 31, 32, brackets can be provided on the unit plate for containers 90, 91. Moreover, the unit plate 30 exhibits a bracket in the area of the two outlet openings 31*a*, 32*a* for detachably securing the mixing device 1, e.g., which can be designed as a plug-in connection (FIG. 41, 42, 43). The connection is designed in such a way that the outlet openings 31*a*, 32*a* in the unit plate 30 correspond with the inlet openings 17*a*, 17*b* of the mixing device 1 (FIG. 16).

Figure 44:
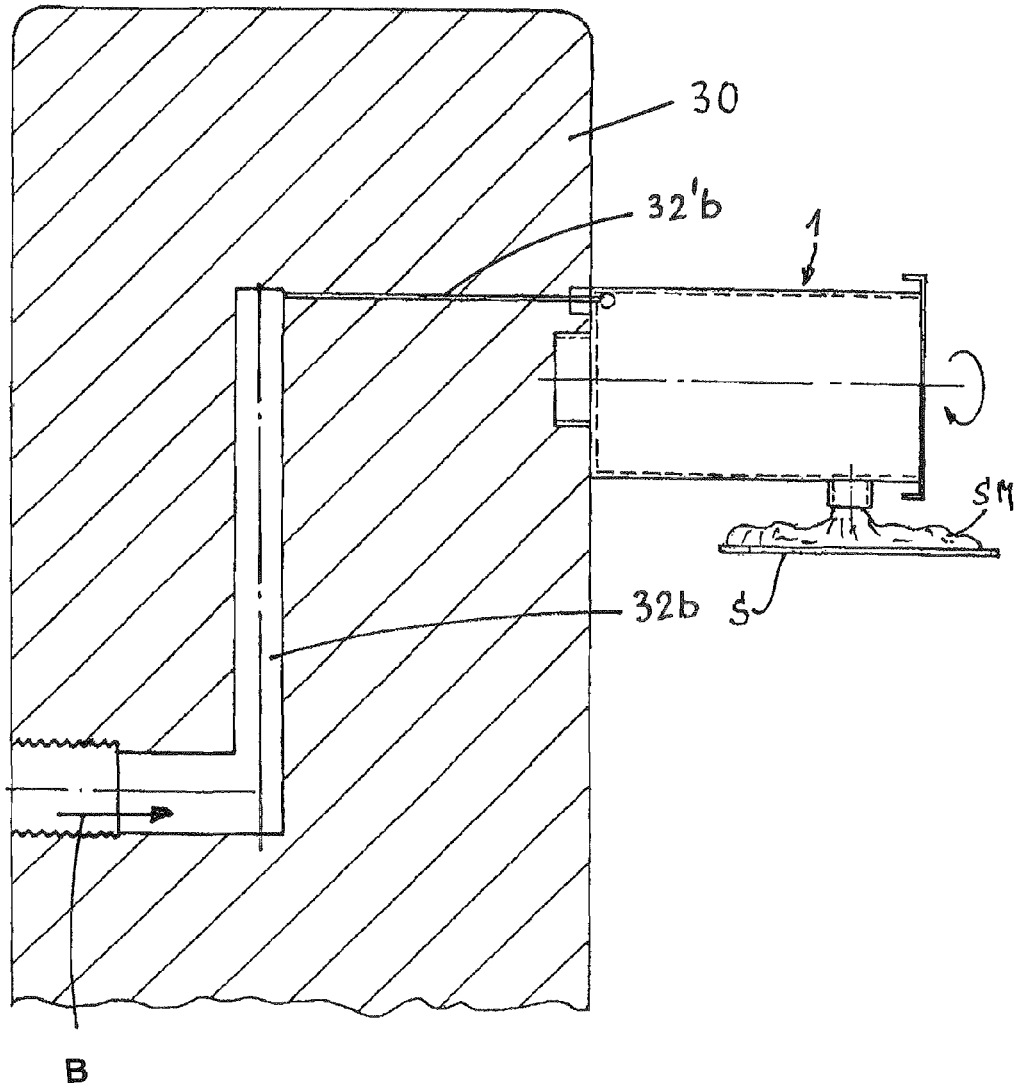
FIG. 44 is a magnified view of a segment of the unit plate with a segment of the feed channel for the curing agent component exhibiting a small diameter, and with an attached mixing device, shown partially in projection, partially in a perpendicular section.
Figure 45:
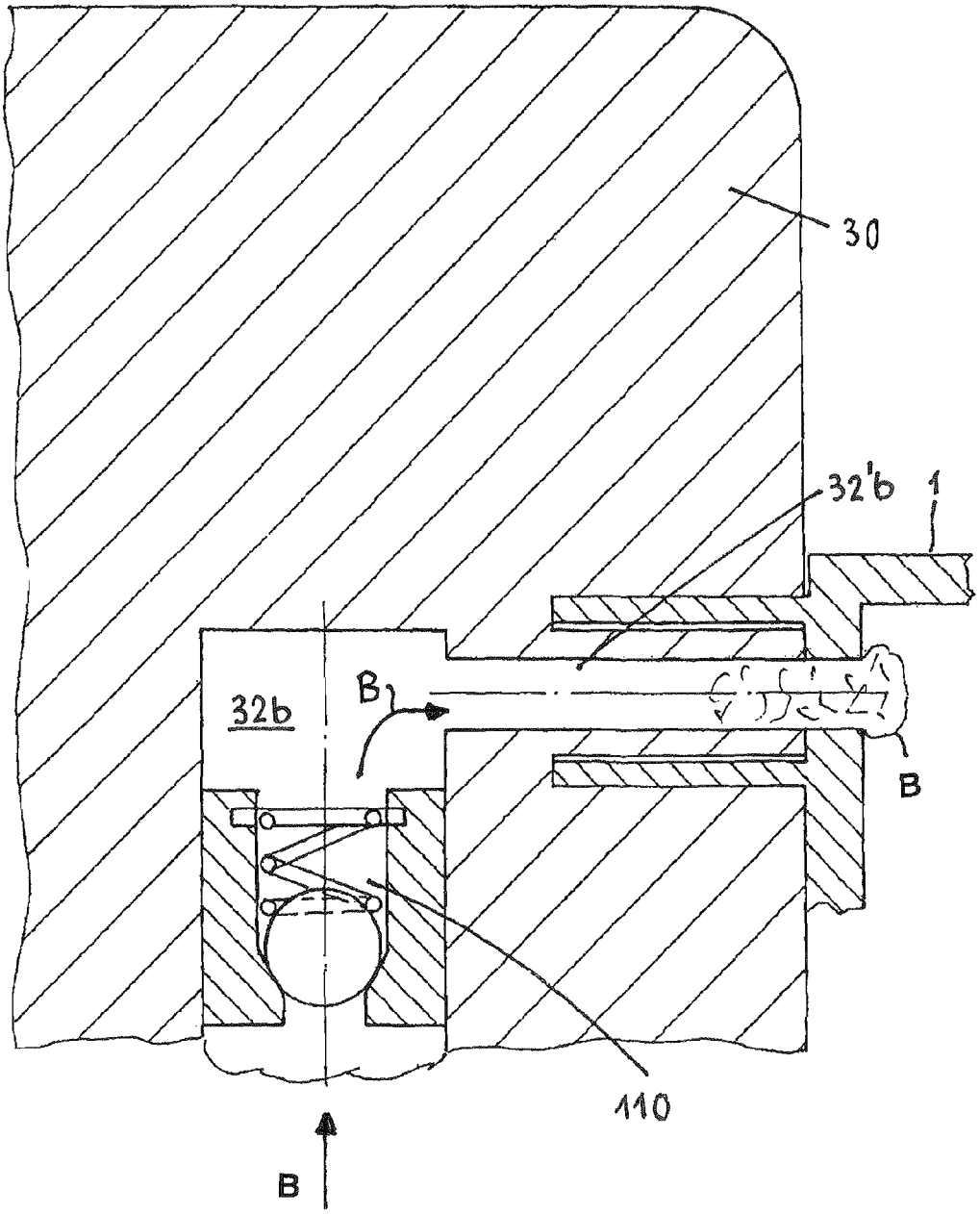
FIG. 45 is a segment of the unit plate with the feed channel for the curing agent component and with attached mixing device, wherein a check valve is placed in the feed channel, shown partially in projection, partially in a perpendicular section.
Figure 46:
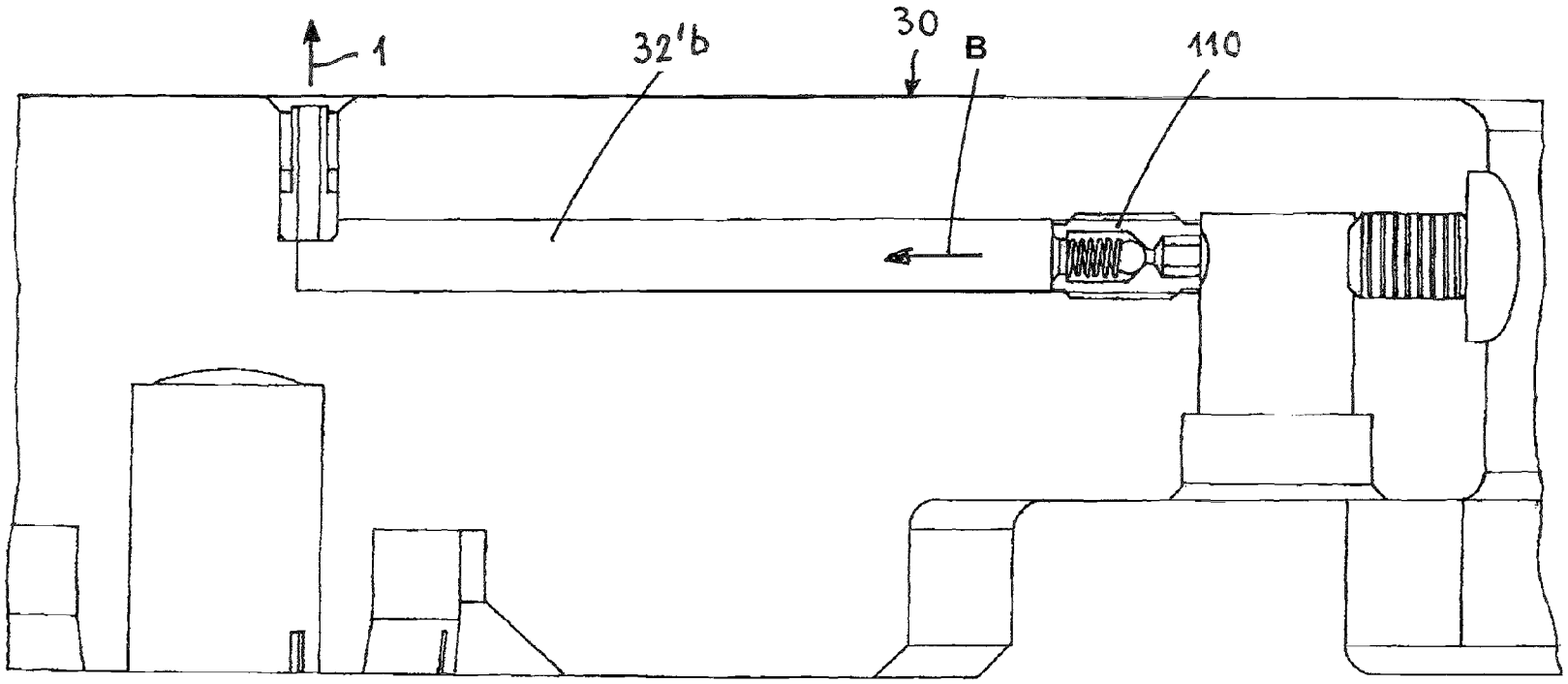
FIG. 46 is a magnified view of a segment of the unit plate with a check valve placed in the feed channel for the curing agent component, shown partially in projection, partially in a perpendicular section.
Figure 47:
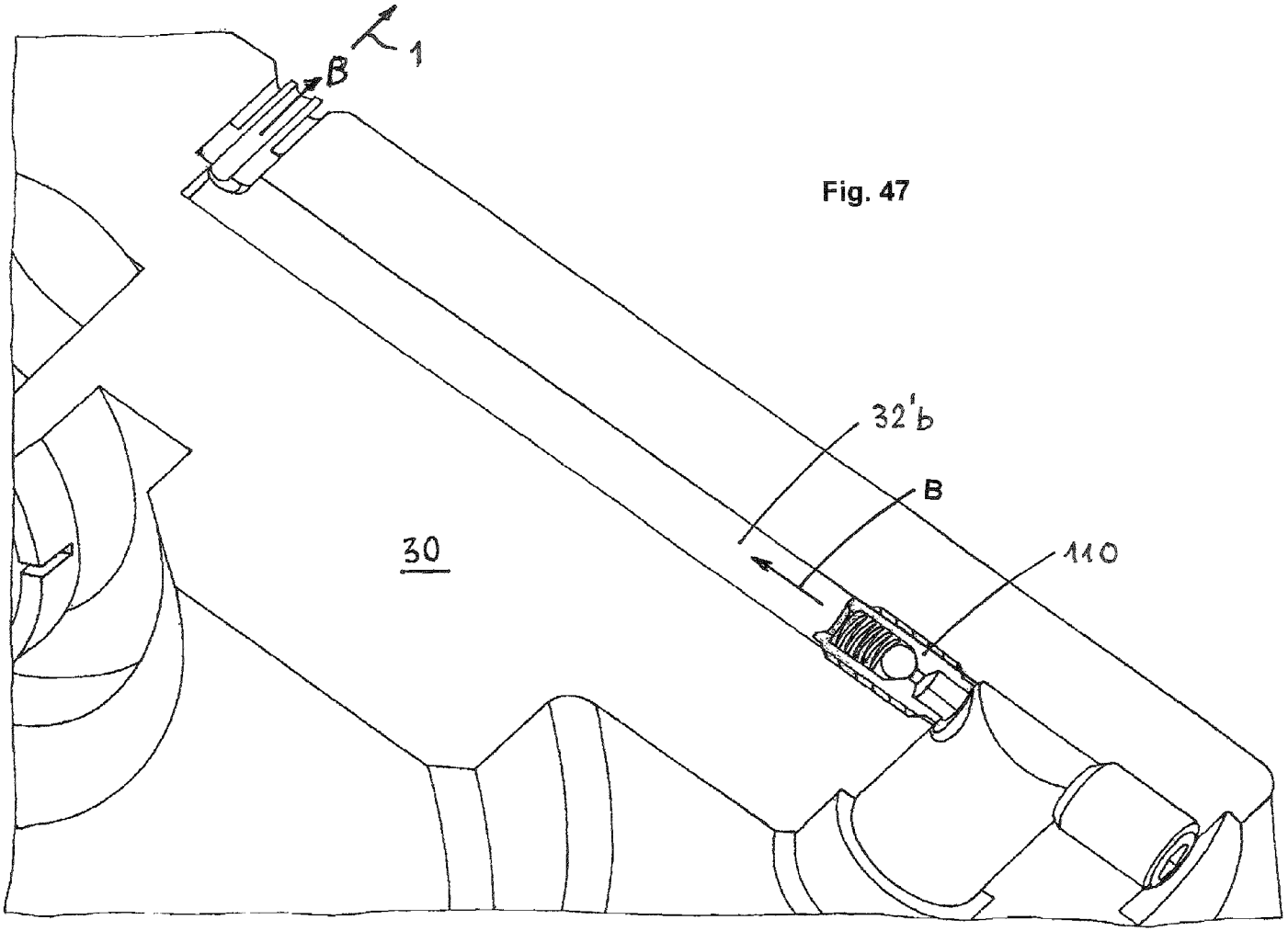
FIG. 47 is another magnified view of a segment of the unit plate with a check valve placed in the feed channel for the curing agent component, shown partially in projection, partially in a perpendicular section.
Figure 48:
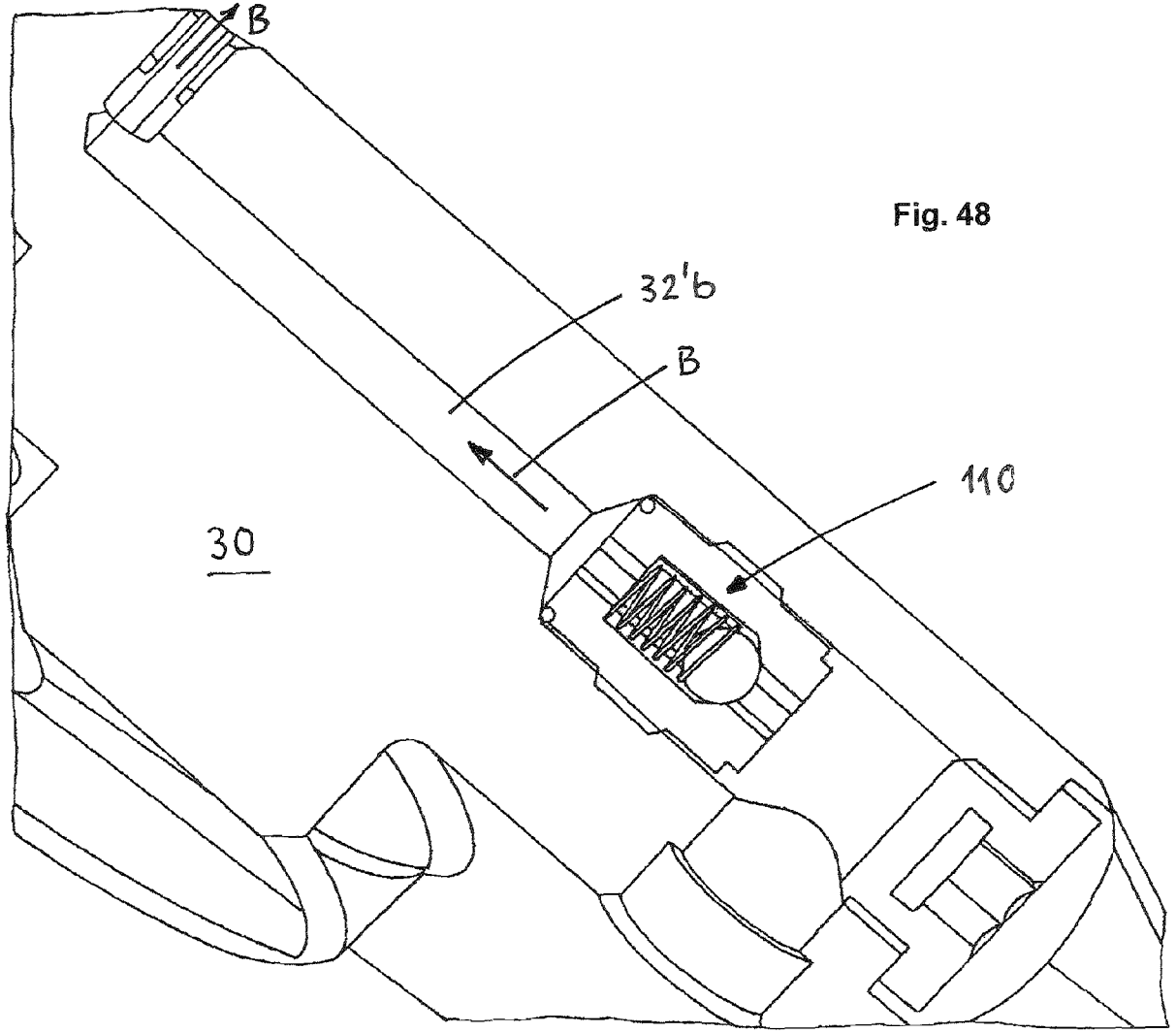
FIG. 48 is another magnified view of a segment of the unit plate with a check valve placed in the feed channel for the curing agent component, shown partially in projection, partially in a perpendicular section, The figures represent exemplary technical embodiments of the present invention; these are also incorporated into the subject matter of the invention.

Furthermore, the unit 100 is designed to supply binder component A and curing agent component B to the mixing chamber 14 of the mixing device 1 in such a way that a slight quantity of curing agent component B is fed to the mixing chamber 14 by expanding the microscopic air bubbles in the curing agent compound as a preliminary injection relative to the supply of binder component A. In order for the microscopic air bubbles to effectively expand, the unit 100 exhibits a cartridge-like container 91 filled to half or three-fourths capacity with curing agent component B, which also can be completely filled with curing agent component. According to the invention, the outlet opening 32*a* in the unit plate 30 for the exit of curing agent component B is here most preferably spaced 1 mm apart from the inlet opening 17*b* for curing agent component B of the mixing chamber 14 of the mixing device 1 attached to the unit plate 30, so that curing agent component B in the unit plate 30 exhibits a diameter of most preferably 1.5 mm or 1.6 mm in a section 32'*b* lying adjacent to the outlet opening 32*a* in the unit plate 30 (FIG. 41, 42, 43, 44). The actual feed channel 32*b* for curing agent component B exhibits a larger diameter in relation to the feed channel section 32'*b*. According to FIG. 44, the diameter for the feed channel 32*b* most preferably measures 6.0 mm, and the diameter for the feed channel section 32'*b* measures 1.5 mm. As a result of this configuration, the expanding microscopic air bubbles cause 0.1 grams to 5.0 grams, most preferably 0.2 grams, of curing agent component B to be sprayed into the mixing chamber 14 before the continuous mixing process begins (FIG. 41, 42, 43).

Figure 42:
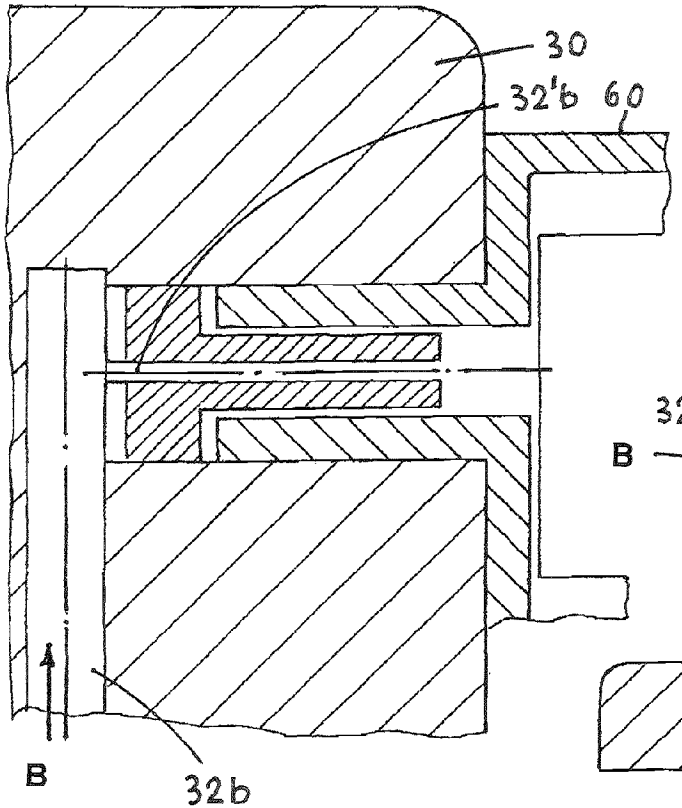
FIG. 42 is another perpendicular section of a segment of the unit plate with the feed channel for the curing agent component, and with an attached mixing device.

The mixing device 1 is braced to the unit plate 30 with the structural configuration according to the invention depicted on FIG. 41, in which the mixing device 1 is inserted or clipped into an annular groove formed in the unit plate 30 in the area of its outlet opening 32*a* for curing agent component B. The bracket or attachment for securing the mixing device 1 is designed in such a way that the mixing device can be replaced with a new, unused mixing device 1 after a batch of filler has been manufactured. In the embodiment shown on FIG. 42, the feed channel 32 *v* for curing agent component B exhibits a diameter of 6 mm, and the end section a diameter of 1.5 mm.

In another embodiment of the unit 100 according to the invention, the latter is designed in such a way as to achieve a thorough mixing of the two components A and B and a perfect, ready-to-use filler without any preliminary injection whatsoever via curing agent component B by introducing curing agent component B into the mixing chamber 14 of the mixing device 1 so as to come into direct contact with binder component A being introduced simultaneously, so that it goes through the mixing process at the same time. To this end, the unit 100 is configured according to FIG. 44 in a way that the feed channel 32*b* exhibits a diameter of most preferably 1.5 mm to 1.6 mm in the area of its end section 32'*b* for curing agent component B in the unit plate 30, and that the mixing device 1 on the unit plate 30 is situated in the area of the outlet openings 31*a*, 32*a* for the two components A and B in such a way that the outlet opening 32*a* for curing agent component B in the unit plate 30 abuts against the inlet opening 17*b* or inlet borehole for curing agent component B of the mixing chamber 14, and is congruent with the latter, wherein the distance between the outlet opening 32*b* and inlet opening 17*b* of the mixing chamber 14 is equal to the wall thickness of the mixing chamber wall 14*a*, most preferably measuring 1 mm. The diameter of the feed channel 32*b* has larger dimensions relative to the diameter of the feed channel section 32*b*, as depicted on FIG. 44.

Figure 43:
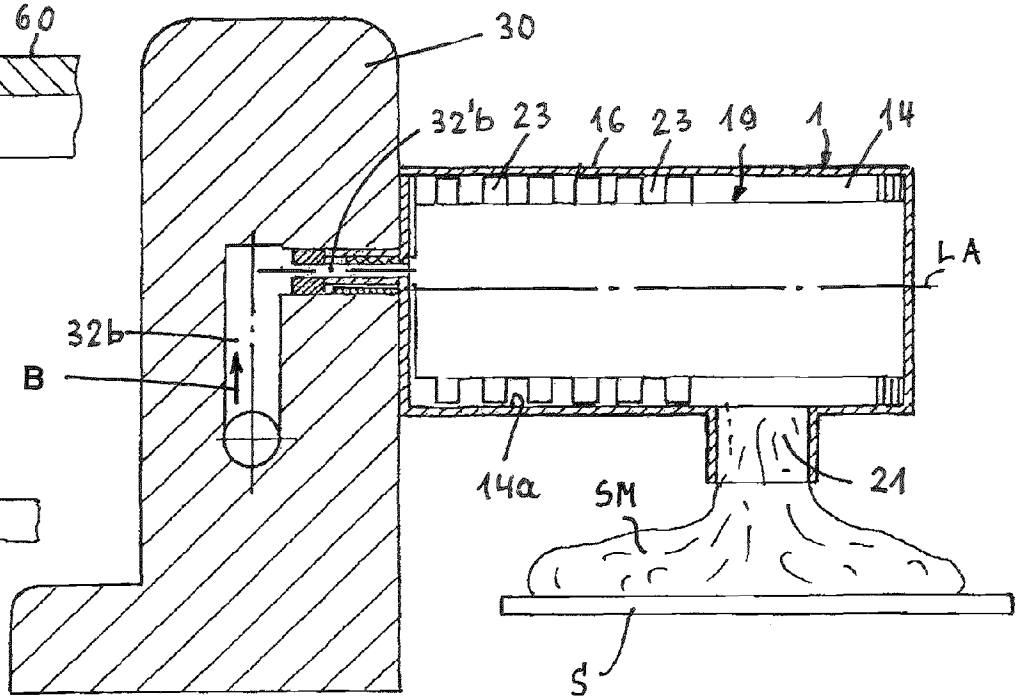
FIG. 43 is another view of a segment of the unit plate with the feed channel for the curing agent component, and with an attached mixing device after the mixture has exited, shown partially in projection, and partially in a perpendicular section.

Because the distance between the outlet opening 32*a* for curing agent component B and the inlet opening 17*b* of the mixing chamber 14 corresponds to the thickness of the mixing chamber wall 14*a*, most preferably measuring 2 mm, the travel distance for the flow of curing agent component B from the outlet opening 32*a* to the inlet opening 17*b* or until entering into the mixing chamber 14 is very short, as a result of which curing agent component B flowing into the mixing chamber 14 impinges upon binder component A, which streams in at the same time. The mixing teeth 23, 24 of the rotating rotor section 19 then mix the two components A and B to yield ready-to-use filler SM, which is dispensed or deposited on a putty knife S (FIG. 43, 44).

Since curing agent component B exhibits a lower viscosity relative to the viscosity of binder component A, the curing agent compound is compressed as it is forced out of its cartridge-like container 91, as well as while passing through the feed channel 32*b* in the unit plate 30, because the curing agent compound incorporates microscopic air bubbles. If the pressure on the curing agent compound is relieved, the curing agent compound expands, causing a reflux of curing agent compound.

In order to prevent this reflux of curing agent component B, the feed channel 32*b* for curing agent component B incorporates a check valve 110, whose arrangement in the feed channel 32*b* and configuration is shown on FIGS. 45, 46, 47 and 48. The check valve 110 is most preferably situated in the feed channel section 32'*b*. In addition to the check valve 110 comprised of a spring-loaded ball, check valves with a differing design can also be used.

The check valve 110 is set in such a way as to close the check valve in response to the slightest pressure on the check valve exerted by a return flow of curing agent compound, so as to avert a reflux.

The invention claimed is:

1. A unit for mixing a binder component from a can-shaped container with a floor plate that closes the floor of the container and has an outlet opening, which is configured to be open with the unit in operation or closed by means of a film, and a curing agent component from a cartridge-like container, into a pasty mixture for manufacturing a ready-to-use filler to fill surfaces, comprising:

a roughly rectangular base plate comprising two end regions;

a plate-like unit plate arranged perpendicularly in one of the two end regions of the base plate, with inlet openings formed on one of the plate sides for supplying the binder component and for supplying the curing agent component, and with outlet openings formed on the other plate side facing away, wherein the inlet openings and the outlet openings are connected via feed channels inside the unit plate;

a mixing device having a fixed stator section and a motorized rotor section incorporated therein, and is detachably and replaceably arranged on the plate side of the unit plate that faces away and exhibits the outlet openings, wherein an annular gap comprising the mixing chamber is formed between the two cylindrical parts;

a first bracket arranged on the base plate in front of the unit plate for the can-shaped container for the binder component and the cartridge-like container for the curing agent component;

a first, longitudinally shiftable plunger situated parallel to the base plate, with a circular plunger plate configured for arrangement inside the can-shaped container at one end, and having an outer diameter corresponding to the inner diameter of the can-shaped container;

a second, longitudinally shiftable plunger situated parallel to the base plate, with a circular plunger plate configured for arrangement inside the cartridge-like container at one end, and having an outer diameter corresponding to the inner diameter of the cartridge-like container, and a hand drive for a controllable, stroke length-dependent forward motion of the wide plunger for controlling the supply of respectively required quantities of the components and from the can-shaped containers into the mixing device to achieve a usable curing result for the manufactured filler, wherein the unit plate has a block-like design, wherein the hand drive for driving and advancing as well as returning the two plungers exhibits a swivelable actuating lever with a slightly angled, shorter lever section, the end of which is held in a U-shaped, bearing-like housing that is held on the base plate, wherein an end of its angled section is connected in such a way with a drive shaft running transverse to a longitudinal axis of the plungers and rotatably mounted in the bearing-like housing that swiveling the actuating lever imparts rotation to the drive shaft having two toothed wheels, which, when the actuating lever is swiveled and simultaneously causes the drive shaft to rotate, engage the teeth in toothed racks of the plungers to advance the plungers by a prescribed amount, wherein a free end of the angled lever segment of the actuating lever facing the drive shaft operatively interacts with a spring, and is provided with a safety catch that is designed as a two-armed angle lever with the two lever arms and pivoted to the actuating lever, wherein a pointed end of its lever arm facing the drive shaft engages into a toothed wheel with asymmetrical tooth flanks arranged on the drive shaft, and wherein the unit plate exhibits a second bracket in an area of the outlet openings for detachably securing the mixing device, which is designed as a plug-in connection, and wherein the connection is designed in such a way that the outlet openings in the unit plate correspond with the inlet openings of the mixing device.

2. The unit according to claim 1, designed in such a way:

a) that the binder component and the curing agent component are supplied to the mixing chamber of the mixing device in such a way that a slight quantity of the curing agent component is fed to the mixing chamber by expanding microscopic air bubbles as a preliminary injection relative to the supply of the binder component, wherein the unit exhibits the cartridge-like container filled to half or three-fourths capacity with the curing agent component to ensure an effective expansion of microscopic air bubbles, wherein the outlet opening in the unit plate for the exit of the curing agent component is spaced 1 mm apart from the inlet opening of the mixing chamber of the mixing device for a travel distance of 1 mm for the flow of the curing agent component into the mixing chamber, wherein the feed channel for the curing agent component in the unit plate for the curing agent component exhibits a diameter of 1.5 mm to 1.6 mm in a section lying next to the outlet opening in the unit plate, and wherein a quantity of 1.2 grams to 5 grams of curing agent component is sprayed or injected into the mixing chamber of the mixing device by expanding the microscopic air bubbles before the continuous mixing process begins, and/or b) that area of the end section of the feed channel for the curing agent component having a lower viscosity relative to the viscosity of the binder component exhibits a diameter of 1.5 mm to 1.6 mm, wherein the mixing device on the unit plate is arranged in the area of its outlet openings for the two components and in such a way that the outlet opening for the curing agent component in the unit plate abuts the inlet opening for the curing agent component of the mixing chamber and is congruent with the latter, wherein the distance between the outlet opening and inlet opening of the mixing chamber measures the wall thickness of the mixing chamber wall of 1 mm, so that the travel distance for the flow of the curing agent component from the outlet opening in the unit plate into the mixing chamber corresponds to the wall thickness of the chamber wall of the mixing chamber.

3. The unit according to claim 2, including a check valve for preventing a reflux of the curing agent component after having relieved the pressure applied to the curing agent compound in the feed channel for the curing agent component in the unit plate, which is set in such a way as to close the check valve in response to the slightest pressure on the check valve exerted by a return flow of the curing agent compound, so as to avert a reflux.

4. The unit as in one of claims 1-3, wherein the drive of the rotor section of the mixing device is designed as an electric motor situated in a housing.

5. The unit as in one of claims 1-3, wherein the mixing device is held between the unit plate and a housing for the drive, and secured in such a way that the mixing device can be replaced, wherein the distance between the unit plate and housing for the drive is variable for changing the mixing device.

6. The unit according to claim 1, wherein the mixing device is used in such a way that the drive shaft of the drive engages the rotor section of the mixing device during operation, wherein the inlet adapters for the binder component and the curing agent component correspond with the outlet openings in the unit plate for binder component and curing agent component.

7. The unit according to claim 1, wherein the free end of the tubular actuating lever is provided with a switch in order to activate and deactivate the electromotive drive for the rotor section of the mixing device, wherein electrical lines run from the switch to the drive in an interior space of the actuating lever.

8. The unit as in one of claims 1-3, wherein the mixing device exhibits a hollow cylindrical stator section with a discharge opening for the mixture formed in its wall, and a rotor section concentrically situated in the latter that can rotate around a longitudinal axis, with a mixing chamber resembling an annular gap formed between the stator section and rotor section, wherein several first mixing teeth molded onto the stator section extend radially inward and several second mixing teeth molded onto the rotor section extend radially outward into the mixing chamber, so that a rotational movement of the rotor section in the stator section causes the mixing teeth to move against each other, thereby mixing the two components together, wherein the stator section exhibits an inlet opening for the binder component and the stator section exhibits an inlet opening for the curing agent component that is connected with the mixing chamber, and wherein first mixing teeth are situated on at least a first mixing teeth plane and second mixing teeth are situated on at least a second mixing teeth plane, wherein the mixing teeth planes are axially offset relative to each other in tiers in a direction of the longitudinal axis, so that the second mixing teeth of the rotor section radially revolve in the respective gaps of the first mixing teeth of the stator section, wherein several mixing teeth planes are provided on the rotor section and/or stator section, wherein the number of mixing teeth planes on the rotor section and stator section are identical.

9. The unit according to claim 8, wherein the second bracket is designed in such a way that the inlet opening for the binder component in the mixing device matches the outlet opening for the binder component in the unit plate, while the inlet opening for the curing agent component in the mixing device simultaneously matches the outlet opening for the curing agent component in the unit plate.

10. The unit according to claim 3, further comprising a can-shaped container, wherein the can-shaped container for the binder component exhibits a cylindrical shape with a circular cross section, and forms a continuous edge of a retracted floor plate with an outlet opening that is centrally or eccentrically positioned in the floor plate, wherein the can-shaped container is provided with a film that is arranged on the interior wall surface of the floor plate and covers the outlet opening of the can-shaped container, wherein the region of the outlet opening of the can-shaped container incorporates a knifelike or saw tooth-fitted cutting blade that functionally acts on the film or a film section in the area of the outlet opening while the binder component is extruded from the can-shaped container, and consists of two crossed, serrated molded bodies with saw teeth facing the film section in the area of the outlet opening to cut into and open the film or film section for purposes of releasing the outlet opening of the can-shaped container so the binder component can exit, wherein the cutting device Is situated in the area of the outlet opening of the can-shaped container or in the area of the inlet opening of the unit plate for binder component.

11. The unit according to claim 10, wherein the cutting device for cutting into and opening the film or a film section is arranged in the area of the outlet opening of the can-shaped container in the exterior wall region of the floor plate of the can-shaped container in such a way that, during or after placement of the can-shaped container on the unit plate in the area of its inlet opening for the binder component, the teeth of the cutting device, when exposed to pressure exerted by the compound of the binder component during the first extrusion process, tear into the film section that closes the outlet opening by making central indentations to form bent, flap-like film sections, releasing an opening to allow passage by the compound of the binder component.

12. The unit according to claim 11, wherein with the can-shaped container placed on the unit plate with the mixing device, the cutting device is situated in the area of the inlet opening of the unit plate corresponding with the outlet opening of the can-shaped container in such a way that the cutting device abuts against the film in the area of the outlet opening of the can-shaped container, wherein the binder component pressed against the outlet opening of the can-shaped container is able to press the film section lying in the area of the outlet opening against the cutting device, thereby destroying or tearing it open by introducing cuts to release the flow of the binder component out of the outlet opening of the can-shaped container.

13. The unit according to claim 12, wherein the cutting device is an integrated component of the can-shaped container, and situated in the area of the outlet opening in the floor plate of the can-shaped container, under the film section that closes the outlet opening.

14. The unit according to claim 13, wherein the can-shaped container for the binder component exhibits a cylindrical shape with a circular cross section, or with another geometric shape exhibiting a corresponding cross sectional design, wherein the floor plate with the outlet opening is retracted so that a continuous edge is formed.

15. The unit according to claim 14, wherein a conically tapering outlet adapter is molded onto the outer wall surface of the floor plate of the can-shaped container in the area of the outlet opening, and can be introduced into the inlet opening of the unit plate for the binder component with the can-shaped container placed on the unit plate.

16. The unit according to claim 15, wherein the cutting device comprises at least one knifelike or serrated molded body with knifelike cutting or saw teeth facing the outlet opening of the can-shaped container.

17. The unit according to claim 16, wherein the cutting device comprises two crossed, serrated molded bodies that are connected with each other or inserted into each other, and exhibit saw teeth, wherein each molded body exhibits saw teeth facing the outlet opening of the can-shaped container.

18. The unit as in claim 16 or 17, wherein all saw teeth of each molded body of the cutting device exhibit identical heights.

19. The unit as in claim 16 or 17, wherein each molded body exhibits a row of teeth, in which every second saw tooth exhibits a greater height relative to the other saw teeth.

20. The unit as in claim 16 or 17, wherein each molded body exhibits a row of teeth, in which the respective outer teeth exhibit a greater height relative to the other teeth, wherein the teeth can exhibit a greater height relative to the other teeth given crossed saw blades in the middle region.

21. The unit as in claim 16 or 17, wherein the row of teeth in each molded body follows an arced, outwardly curved progression.

22. The unit as in claim 16 or 17, wherein each molded body exhibits a row of teeth comprised of sections of toothed rows extending conically toward the middle of the molded body, wherein the outer end regions of the two rows of teeth pass over into sharpened, knife-like sections.

23. The unit as in claim 16 or 17, wherein each molded body consists of two rows of teeth each exhibiting at least two teeth, and extend conically toward the middle of the molded body, wherein the outer end regions pass over into teeth resembling taper taps or arrow tips.

24. The unit according to claim 23, wherein the teeth of the rows of teeth in the molded bodies are sharpened.

25. The unit as in one of claims 1-3, further comprising a can-shaped container, wherein the film of the can-shaped container consists of a plastic, has a smooth design, or is provided with a corrugation or pleating.

26. The unit as in one of claims 1-3, wherein the unit visibly exhibits an optical signaling device, such as a white or color light-emitting signaling lamp and/or an acoustic signaling device, such as a signaling horn or siren, connected with a power source, wherein the two signaling devices are situated on the housing that incorporates the electromotive drive, and are activated by lighting up and/or outputting signals for a prescribed period of two or three or even more minutes when the unit is commissioned.

27. The unit as in one of claims 1-3, wherein two vessels for holding used and unused mixing devices are arranged on the base plate of the unit.

* * * * *